United States Patent [19]

Beers

[11] Patent Number: 4,613,193

[45] Date of Patent: Sep. 23, 1986

[54] BOARD-OPERATED ELECTRICAL CONNECTOR FOR PRINTED CIRCUIT BOARDS

[75] Inventor: Howard L. Beers, Cape Coral, Fla.

[73] Assignee: Tritec, Inc., Naperville, Ill.

[21] Appl. No.: 639,832

[22] Filed: Aug. 13, 1984

[51] Int. Cl.[4] ..... H01R 13/629

[52] U.S. Cl. ..... 339/17 L; 339/75 MP; 339/91 R; 339/176 MP

[58] Field of Search ..... 339/17 L, 74 R, 75 MP, 339/91 R, 176 MP

[56] References Cited

U.S. PATENT DOCUMENTS

| | | | |
|---|---|---|---|
| 3,970,353 | 7/1976 | Kaufman | 339/176 MP |
| 4,118,094 | 10/1978 | Key | 339/176 MP |
| 4,221,448 | 9/1980 | Logerot et al. | 339/176 MP |
| 4,288,140 | 9/1981 | Griffith et al. | 339/74 R |
| 4,487,468 | 12/1984 | Fedder et al. | 339/176 MP |

FOREIGN PATENT DOCUMENTS

| | | | |
|---|---|---|---|
| 885040 | 12/1961 | United Kingdom | 339/176 MP |

*Primary Examiner*—John McQuade
*Attorney, Agent, or Firm*—Clement and Ryan

[57] ABSTRACT

An electrical connector for printed circuit boards having two or more rows of printed terminals along one edge of the board. When the board is inserted in the connector body, the contacts within the connector are prevented from making contact with any printed terminals on the circuit board until the board has reached its operative position within the connector and all the contacts are aligned with the printed terminals they are intended to make contact with. The contacts within the connector are carried by resiliently deformable supports. When the board is inserted in the connector it preferably imparts translational movement to a carriage on which actuators are mounted, and the actuators press the deformable supports and their contacts against their associated printed terminals on the printed circuit board. In this way, the board passes through four positions—safe, ready, initial contacting, and final operative positions—after it is inserted in the connector.

34 Claims, 39 Drawing Figures

FIG. 4
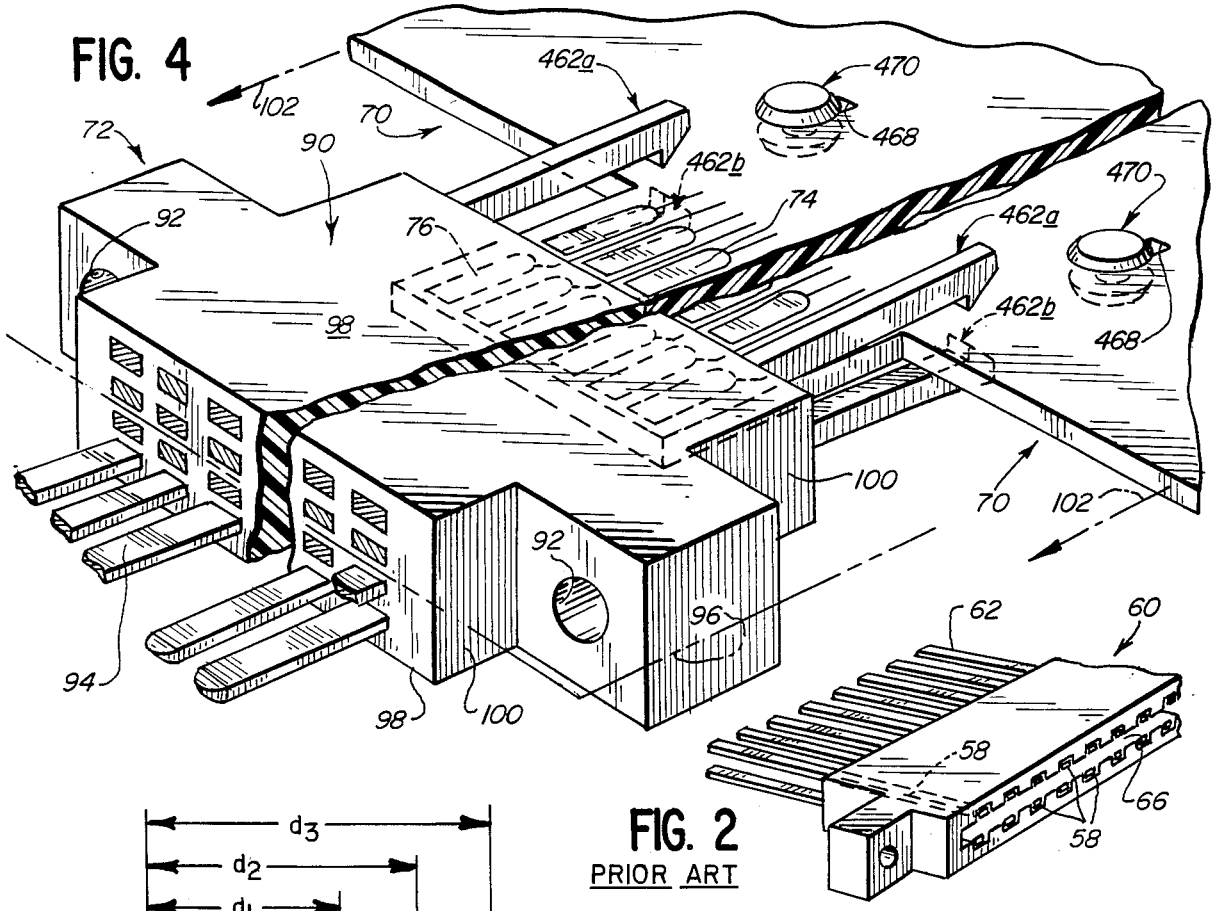
FIG. 2
PRIOR ART
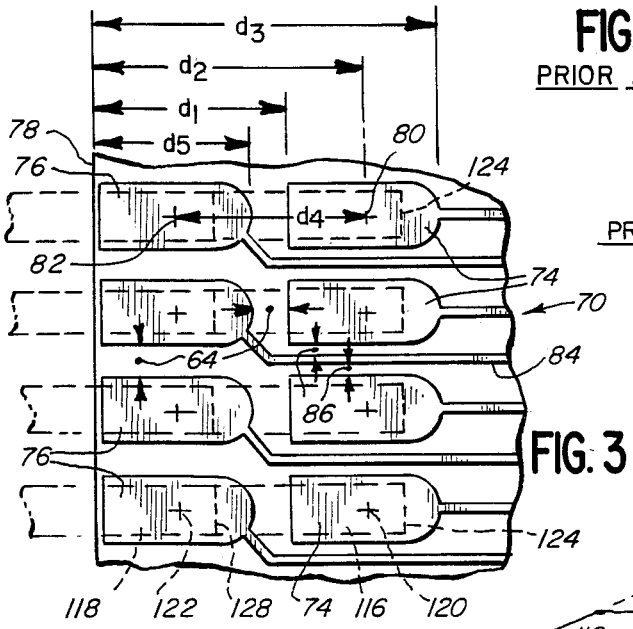
FIG. 3
FIG. 1
PRIOR ART
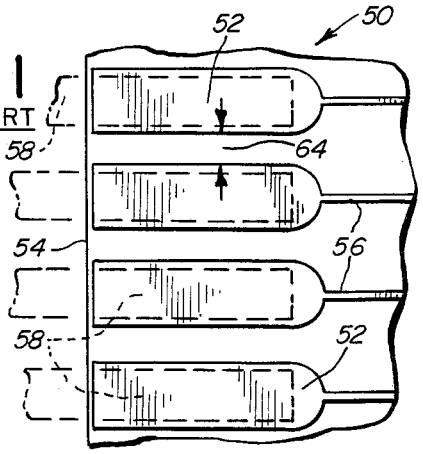
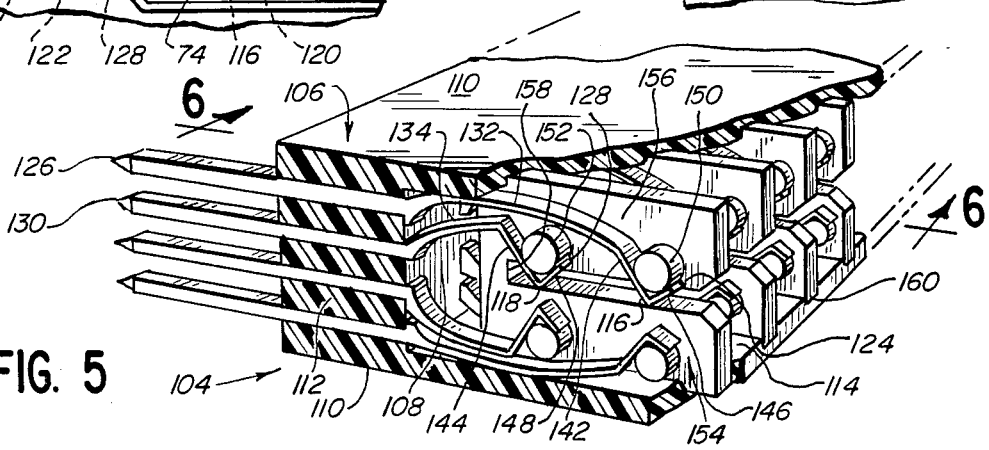
FIG. 5

FIG. 16
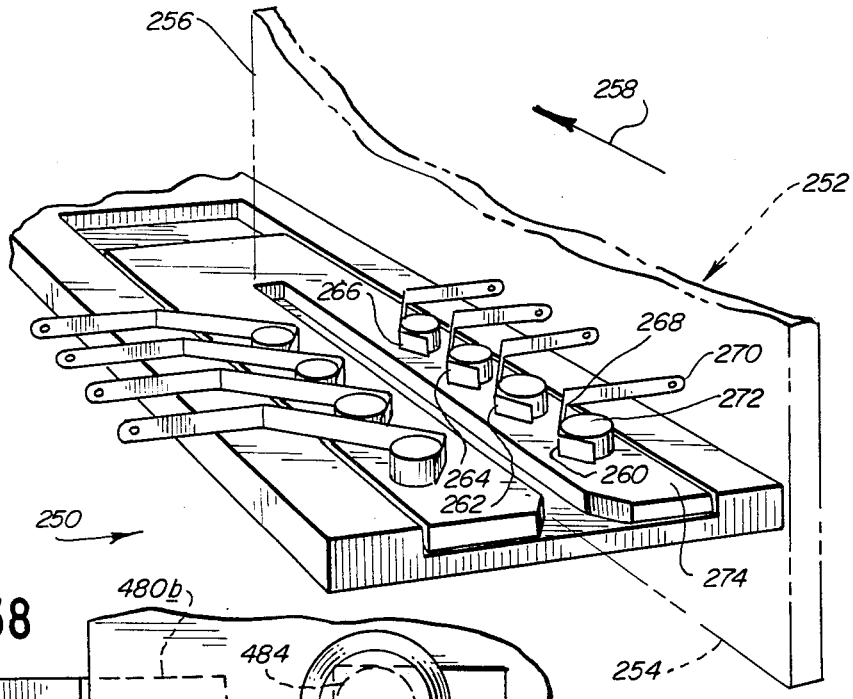
FIG. 38
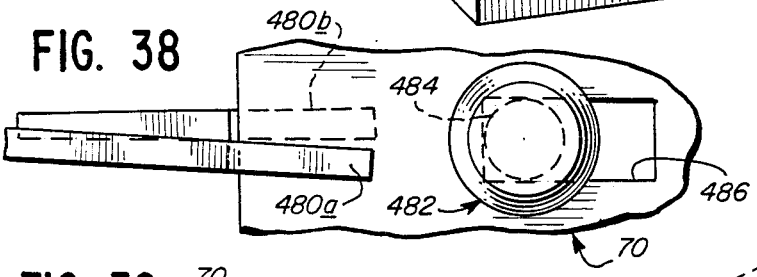
FIG. 39
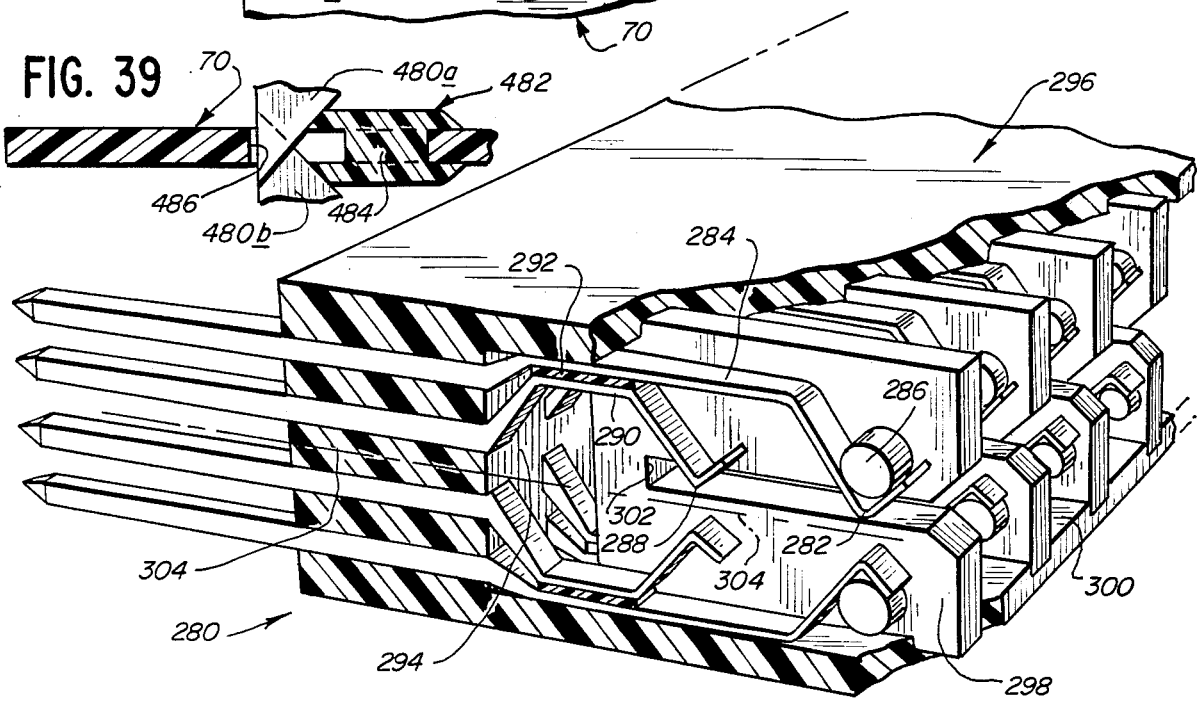
FIG. 17

BOARD-OPERATED ELECTRICAL CONNECTOR FOR PRINTED CIRCUIT BOARDS

This invention relates to an electrical connector for connecting the printed terminals on a printed circuit board with other parts of the electrical system with which the printed circuit board is used, and in particular to such a connector that is automatically operated by insertion of the printed circuit board within the connector body.

BACKGROUND OF INVENTION

Transistors and printed circuit boards came into use in various electrical systems nearly simultaneously. They provided a natural combination of components which added greatly to the miniaturization of electronic circuitry.

The connection of the printed circuit board with other parts of the electrical system with which it was used was first accomplished by simply soldering wires on the board and connecting them to a wiring plane or another printed circuit board. Connectors were soon developed which consisted of a connector blade soldered to the printed circuit board, with the blade making contact with another connector blade on a wiring plane or on another printed circuit board. These connectors were arranged as male or female connectors, as the need dictated.

As semiconductor technology advanced, so did the density of the various components contained on a given printed circuit board. Before long, it became apparent that considerable money could be saved if half of the mating connectors could be eliminated, in particular the part that was located on the printed circuit board. Significant strides were made at that time in arranging the printed circuit board to be a male member of a mating contact. These contacts were then arranged along the edge of the printed circuit board, and the board was inserted in the female side of the connector.

The advance of semiconductor technology tended to remove more and more discrete components and place them on integrated circuit chips. The use of such chips led to printed circuit boards of increasing complexity in function. However, as the number of external connections with various components of the printed circuit board increased, there was a limit on the maximum number of such connections that is possible with a connector of a given size.

As a consequence, efforts have been made to increase the "density" of printed terminals on the printed circuit board both by decreasing the width of each terminal and by decreasing the spacing between adjacent terminals. Such efforts are limited by the fact that if the terminals are made too narrow, there is a substantial loss of connector current capacity by reason of the reduced area of contact, and in addition it is difficult to assure proper alignment between the narrower terminals and their associated contacts within the card edge connector. There is also an irreduceable minimum spacing that must be maintained between terminals.

The most recent method of increasing density is to install a separate connector on the printed circuit board in lieu of printed terminals, which doubles the cost with only a slight reduction of insertion force. This expedient amounts to providing two mating connections where there was previously only one.

Various other attempts have been made to increase the number of printed terminals on a printed circuit board that can be accommodated in card edge connectors by changing the structure of the connector itself. However, all attempts of this kind of which applicant is aware have had some shortcoming.

One of these approaches has been to employ stepped terminals on the printed circuit board and correspondingly stepped contacts in the connector, as in Japanese laid-open document No. 58-70688. Such a connector is expensive to make, requires a thicker printed circuit board than is ordinarily used, and does nothing to meet the problem of high insertion and retraction forces that will be discussed below.

Another attempt to increase the density of the printed terminals with which the connector can be used utilizes two rows of printed terminals, with the terminals staggered as one moves alternately along one row and then the other. The contacts in the connector are similarly staggered to match up with the pattern of the terminals. Examples of this type of connector are shown in Japanese laid-open documents Nos. 51-162966, 55-8212 and 55-38411. As will be seen from FIG. 3 of the first mentioned document, this approach results in an increase of only a fraction of the total number of terminals that can be accommodated by the connector.

A third approach sometimes doubles the density of the printed terminals on the printed circuit board, but in every case produces another troublesome problem —unwanted and dangerous contacts between unmatched printed terminals on the circuit board and contacts within the card edge connector. Examples of such connectors are disclosed in Japanese laid-open documents Nos. 53-132654, 56-61777, 57-69795 and 58-188995.

In addition to the indicated spacing constraints, conventional electrical connectors of the male/female type have presented another problem. Such card edge connectors presently in use must maintain relatively high contact pressure between the terminals on the printed circuit board and the contacts connected with the output leads of the connector, because they supply the only force holding the connector blades against the printed circuit board. In fact, the pressure that is required to be maintained between the printed terminals of a printed circuit board and the associated contacts within the card edge connector is often so high that the circuit board can not be inserted within the connector simply by being pushed in, but must actually be hammered in by the user of the system.

The pressure between a printed circuit board and the contacts within a card edge connector that causes the board to be inserted into the connector only with extreme difficulty makes it nearly as difficult to extract the board from the connector. This difficulty is further compounded by the fact that generally neither the connector nor the printed circuit board can be grasped conveniently to exert the necessary extration force, and various tools have had to be developed to assist in applying such force to pry to the two members apart.

Zero insertion force and low insertion force connectors are known, but many of them are unnecessarily complicated in structure and none meets the problem of printed terminal density discussed above.

Applicant's invention meets both the problems discussed, by (1) making possible a greatly increased number of printed terminals on the printed circuit board that can be accommodated by this connector, and (2)

achieving a secure mode of connection without having to employ the very high contact pressure that is required with conventional connectors.

SUMMARY OF THE INVENTION

The connector of this invention may be used with a printed circuit board that has at least twice the number of printed terminals that is possible with a conventional connector, typically arranged in at least two rows along the leading edge of a circuit board that is inserted within the connector body.

This connector comprises specially supported and actuated contacts within a connector body that is formed of insulative material, into which body one edge of a printed circuit board carrying a plurality of rows of terminals can be inserted. Each contact is supported by resiliently deformable support means that normally supports the contact in its open position. Actuator means is provided for each resiliently deformable support means, as well as means for operating the actuator means in automatic response to the insertion of the printed circuit board within the connector body.

When the printed circuit board has been inserted within the connector body, it can be moved certain defined or predetermined distances successively to (1) safe, (2) ready, (3) initial contacting, and (4) fully operative positions.

As the board is inserted in the connector and the leading edge of the board moves a defined predetermined distance, the terminals nearest that board edge are carried safely beyond the first row of contacts that they encounter, without making any contact with those contacts.

As the board moves another defined distance, the operating means gets the actuator means ready to move the contacts into initial contact with their respective printed terminals on the printed circuit board.

When the printed circuit board has been moved another defined distance, the operating means causes the actuator means to move the contacts into initial contact with their respective printed terminals on the circuit board. Up to this point, the contacts have been held by their resiliently deformable support means in their normal open positions, spaced from any printed terminals on the printed circuit board.

Finally, when the printed circuit board has been moved still another defined distance into the connector body, the contacts are caused to move into their fully closed positions in full pressure contact with their respective printed terminals.

With this arrangement, any given row of contacts will avoid coming into premature, unwanted contact with any row of terminals on the printed circuit board, and will contact only the row of terminals with which it is associated and which it is intended to contact.

Carriage means, lying entirely outside the predetermined path followed by the printed circuit board within the connector body and preferably located to move alongside the above mentioned contacts and their supports, provides one form of means for operating the actuators. The contacts are preferably supported on electrically conductive springs, which in a preferred embodiment have slanting portions against which pins carried by the carriage means are pressed when the carriage means is moved by insertion of the printed circuit board into the connector body.

With the electrical connector of this invention, the operating means may operate the respective actuator means for the contacts directly, as for example by means of the carriage already mentioned. Or, if desired, the operating means may operate a given one of two actuator means directly, with that operation indirectly resulting, in turn, in the operation of another actuator means for another contact.

A preferred latch/delatch mechanism is provided that is operated by insertion of the printed circuit board a still greater distance into the connector body. The latch/delatch device utilizes the lost motion action of a plug slidably mounted in a slot inthe printed circuit board to deactivate a set of pawls that hold the circuit board securely in place until the board is pushed by the user the additional distance just mentioned.

ADVANTAGES OF THE INVENTION

The electrical connector of this invention has the following advantages:

1. Very little force is required to overcome the slight frictional and bending resistances involved when the printed circuit board is inserted in the connector.

2. During insertion of the printed circuit board in the connector, the energy required for insertion is largely stored by reason of the deformation of the resilient contact support means, and this stored energy is thereafter available to assist in ejecting the printed circuit board from the connector.

3. A wiping action is provided between each contact in the electrical connector and its associated terminal on the printed circuit board during insertion of the board in the connector. The wiping action is of sufficient magnitude that it will scrape through any oxide film that may be present on either the printed terminal of the circuit board or on the associated contact of the connector means.

4. The number of terminals that can be accommodated along one edge of the printed circuit board can be increased by a factor of two, three or even more. In other words, the "density" of the printed terminals on the printed circuit board, and their respective contacts in the connector means, can be very significantly increased.

5. Although the density of the printed terminals is increased by using two parallel rows of terminals along one edge of the printed circuit board and when that edge of the board is inserted in the connector body one of the rows of terminals must move past a row of contacts which it is not intended to make contact with, in the connector of this invention no accidental contact is permitted between the contacts and any printed terminals on the board. No contact at all is permitted until the board has safely reached its operative position within the connector and all the contacts are aligned with the printed terminals that they are intended to make contact with.

6. With the electrical connector of this invention, it is possible to arrange the terminals on a printed circuit board at the top or bottom of the board, rather than only on the card edge that is inserted in the connector. Because of this fact, no special card guides or tracks are required, and the heat producing elements of the electronic system can be positioned in a unique and advantageous manner.

7. The special latch/delatch mechanism for the electrical connector of this invention provides a positive retention of the printed circuit board within the connector body as long as is desired. At the same time, when it is desired to remove the printed circuit board from the connector, the board can thereafter be removed with a very small application of force.

BRIEF DESCRIPTION OF THE DRAWINGS

The invention will be described in connection with the accompanying drawings, in which:

FIG. 1 is a plan view of a portion of a conventional printed circuit board with a single row of printed terminals adjacent one edge of the board, showing in dashed outline the connector blade within the connector body that overlies each printed terminal;

FIG. 2 is a reduced, fragmentary, perspective view of a conventional card edge connector for use with the printed circuit board shown in FIG. 1;

FIG. 3 is a plan view of a portion of a printed circuit board, with two rows of printed terminals adjacent one edge of the board, which may be used with one embodiment of the electrical connector of this invention;

FIG. 4 is a fragmentary perspective view of one embodiment of the electrical connector of the present invention with the printed circuit board of FIG. 3 just being inserted within the connector body, with portions of the printed circuit board, connector body and output prongs broken away for clarity;

FIG. 5 is a broken-away perspective view of one embodiment of the electrical connector of this invention in which the actuator means for all contacts in the connector are directly operated;

FIG. 16 is a fragmentary perspective view of a schematic showing of an electrical connector according to this invention for use with a printed circuit board having four printed terminals in a column along an edge of the circuit board that is perpendicular to the leading edge of the board as it is inserted within the connector body;

FIG. 17 is a broken away perspective view of another embodiment of the connector of this invention in which the actuator means for the first contact is directly operated and the actuator for the second contact is indirectly operated;

FIG. 38 is a top plan view of another embodiment of a latch/delatch mechanism that can be used with the connector of this invention; and FIG. 39 is a view similar to FIG. 32, showing the embodiment of FIG. 38 in the position it occupies when it retains the printed circuit board within the connector body.

DETAILED DESCRIPTION OF SEVERAL EMBODIMENTS OF THE INVENTION

Figure 6:
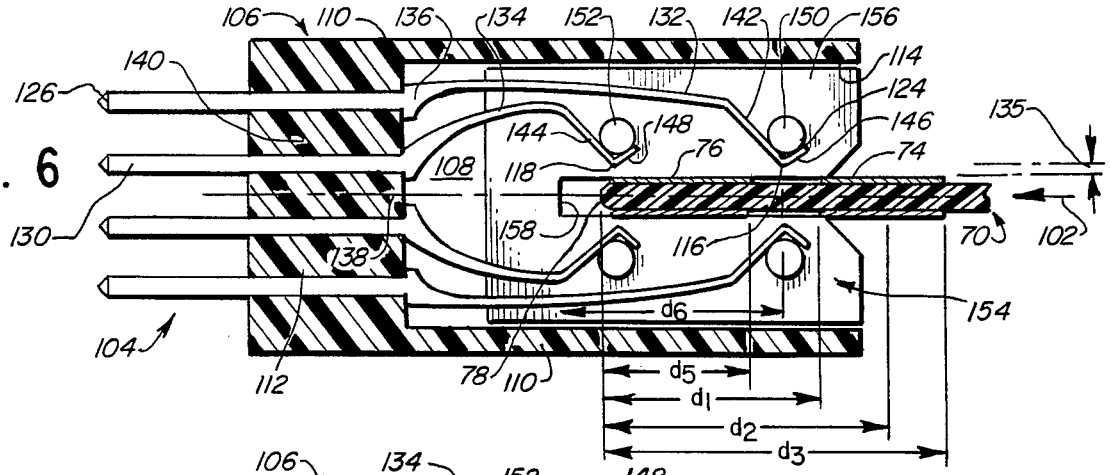
FIG. 6 is a sectional view taken along the line 6—6 in FIG. 5, showing the printed circuit board in its safe position as it is being inserted into the connector body.

The connector of this invention will now be described, by reference to the accompanying drawings, in relation to several specific embodiments of the invention.

Typical Printed Circuit Board And Connector In Current Use

FIG. 1 is a plan view of a portion of a typical printed circuit board in current use, and FIG. 2 is a fragmentary perspective view of a card edge connector in common use with such circuit boards.

Printed circuit board 50 has one row of printed terminals 52 disposed along first edge 54 of the board. Terminals 52 are connected by leads 56 to various portions of the circuitry contained on the printed circuit board.

Contacts 58, contained in card edge connector 60 (shown in reduced size in FIG. 2), make contact with terminals 52 when printed circuit board 50 is inserted in connector 60. Output leads 62 carried by connector 60 are used to connect printed terminals 52 with other parts of the electrical system with which the printed circuit board is used.

The maximum number of printed terminals 52 that can be positoned along edge 54 of printed circuit board 50 is limited by the minimum acceptablc width of the terminals and the minimum spacing 64 that is acceptable between immediately adjacent printed terminals.

In addition, as is apparent from FIG. 2, when leading edge 54 of circuit board 50 is pushed into space 66 between opposed rows of contacts 58 within card edge connector 60, considerable force will be required because of the high level of pressure that must be provided between contacts 58 and terminals 52 to assure a secure electrical connection. Nearly the same force will be required to remove the printed circuit board from the connector.

Both these problems are overcome by the connector of the present invention.

Circuit Board Having Two Rows of Terminals For Use With One Embodiment Of This Invention FIG. 3 is a fragmentary plan view of a printed circuit board 70 that can be used with the embodiment of this invention shown as connector 72 in FIG. 4.

In FIG. 3, a pair of printed terminals made up of first terminal 74 and second terminal 76 is arranged in a column oriented transverse to first edge 78 of circuit board 70, and this pattern is repeated along edge 78 to produce a multiplicity of such pairs of terminals. First terminal 74 lies farther than second terminal 76 from board edge 78.

As seen in FIG. 3, the boundary of printed terminal 74 that is nearest edge 78 of the board is located at first predetermined distance $d_1$ from the edge. Geometric center 80 of terminal 74 lies a second predetermined distance $d_2$ from board edge 78. The boundary of printed terminal 74 that is most remote from edge 78 lies a third predetermined distance $d_3$ from the edge.

The geometric center 80 of terminal 74 is spaced from geometric center 82 of terminal 76 by a fourth predetermined distance $d_4$. Finally, second printed terminal 76 lies with its boundary that is most remote from edge 78 at fifth predetermined distance $d_5$ from the board edge.

The printed terminals of printed circuit board 70, like those of board 50 in FIG. 1, are spaced from each other laterally by the minimum acceptable distance 64. In addition, they are spaced from each other by the same minimum distance 64 longitudinally as well. Moreover, each lead 84 that is connected with a printed terminal 76 is spaced by an acceptable minimum distance 86 from each terminal 74 past which the lead runs to its respective component of the circuitry on printed circuit board 70.

As mentioned above, the pair of printed terminals 74,76 on printed circuit board is repeated along board edge 78. In other words, additional pairs of printed terminals similar to pair 74,76 identified at the top of FIG. 3 are disposed adjacent edge 78 to form a multiplicity of pairs of terminals spaced from each other.

Each of these additional terminals is arranged in a column transverse to edge 78, in a manner similar to the arrangement of terminals 74 and 76 in the first pair of printed terminals. Moreover, each of the additional terminals has associated with it in the connector of this invention an output lead, a contact, resiliently deformable support means, actuator means and operating means, all as will be described below for the first pair of terminals.

Comparing printed circuit boards 50 and 70 in FIGS. 1 and 3 shows that the latter provides a density of printed terminals (in rows 74 and 76) at first board edge 78 that is double the density of the printed terminals along edge 54 of board 50 (in single row 52). This doubling of the density of printed terminals is accomplished with the terminals maintained at the same width as the terminals in conventional printed circuit board 50, and with the terminals and their leads maintained at the necessary minimum distances from each other.

General Construction Of Connector

The general construction of the electrical connector of this invention will first be described, followed by a description of the particular arrangements of parts in connectors having various modes of board-operation.

Connector Body

In FIG. 4, connector body 90 of electrical connector 72 is a long, narrow, hollow body formed of rigid, insulative material. (It is shown in this Figure broken away for clarity.) Holes 92 at either end of connector body 90 receive bolts or other means for attaching the connector body to the cage in which printed circuit board 70 is to be used. Output leads 94 (broken away for clarity) are fixedly attached to tne connector body and extend outward therefrom.

Connector body 90 has a median plane 96 through its vertical center in FIG. 4. Main walls 98 are parallel to the median plane, and are connected by narrow walls 100. Walls 98 and 100 together define the interior of the connector body, and define an opening (on the far side of connector body 90 in FIG. 4) for receiving printed circuit board 70 in the manner to be described below.

When circuit board 70 is inserted by the user of the connector of this invention in the boardreceiving opening just mentioned, the board is guided through predetermined path 102 into an operative position (shown in later Figures) within the interior of connector body 90. In that operative position, board 70 is disposed generally parallel to main walls 98 of the connector body.

The structure shown in the upper right-hand portion of FIG. 4 will be described in a later section of this specification.

Contacts

FIG. 5 is a broken-away perspective view of one embodiment 104 of the electrical connector of this invention.

Connector body 106 houses various elements of the connector in interior 108 that is defined by main walls 110 and narrow walls 112 (one of which is seen at the left-hand side of FIG. 5.) Walls 110 and 112 also define opening 114 for receiving the printed circuit board to be used with this connector.

First contact 116 and second contact 118 are contained within connector body interior 108. The two contacts are arranged in a column transverse to board-receiving opening 114, with first contact 116 positioned nearer to said opening. The geometric centers of contacts 116 and 118 are spaced from each other by a distance preferably about equal to distance $d_4$ shown in FIG. 3 as the distance between the geometric centers of first printed terminal 74 and second printed terminal 76 of printed circuit board 70.

First contact 116 and second contact 118 are shown in dashed outline in FIG. 3, with their respective geometric centers indicated at 120 and 122. As will be seen, contacts 116 and 118 overlie printed terminals 74 and 76, respectively, of printed circuit board 70 when the board has been inserted in connector 104 and has been moved to its operative position. Each contact makes contact only with its associated printed terminal, and with no other.

As is seen from FIGS. 3 and 5, contact 11 has a free end 124 that is associated with printed terminal 74 of printed circuit board 70 and is electrically connected with output lead 126. Similarly, second contact 118 has a free end 128 associated with printed terminal 76 and electrically connected with output lead 130.

To increase the available contact area, contacts 116 and 118 are rounded and preferably bifurcated.

In FIG. 5, contacts 116 and 118 are shown in their open positions, as will be explained below and illustrated in other Figures of the drawings. Contacts 116 and 118 also have closed positions for contact with their associated printed terminals, as illustrated in other Figures and explained below.

Supports For Contacts

FIG. 6 is a sectional view of the connector of FIG. 5, taken along line 6—6 in that Figure. As seen, first contact 116 is supported by resiliently deformable support 132 which normally supports the contact in its open position. Likewise, second contact 118 is carried by resiliently deformable support 134 and is normally supported by that member in its open position. In their normal open positions, contacts 116 and 118 are spaced from the plane in which the top surfaces of printed terminals 74 and 76 lie, when printed circuit board 70 is inserted in connector 104, by a gap indicated as 135 in FIG. 6.

Contact 116 is preferably integrally formed, as shown in FIG. 6, with its resiliently deformable support means 132. In the embodiment shown, support 132 has the form of an elongated, electrically conductive flat spring member fabricated from a suitable metal such as a phosphor-bronze alloy. Contact 118 is similarly integrally formed with its support 134.

In connector 104, supports 132 and 134 have rectangular cross-sections. The supports may be formed of any other suitable cross-section, as desired, such as for example a round spring wire.

Base portion 136 of support 132 is anchored to connector body 106 with the other end of the support carrying its associated contact 116. In the embodiment shown, supports 132 and 134 are arranged one upon the other in a stack normal to median plane 138 of connector body 106, with the two base portions of the supports being separated by electrically insulative material 140.

Support 132 thus provides an electrical connection between contact 116 and output lead 126, and support 134 connects contact 118 with output lead 130. At the same time, each support is insulated, together with its associated contact, from the other contact and its support. In addiion to the use of electrical insulative material 140, the insulation of each contact and its associated support from the other contact and its support is maintained by having the free end of elongated support means 132 for first contact 116 extend closer to board-receiving opening 114 than does the free end of elongated support means 134 for second contact 118.

In the embodiment shown, support 132 for the first contact overlies support 134 for the second contact. Other arrangements of the two supports may be used, if desired, so long as they remain insulated from each other.

A first portion 142 of elongated, flat spring member 132 slants diagonally with respect to median plane 138, with the end of portion 142 that is nearer to board-receiving opening 114 being closer to the median plane than is the other end. In the same way, first slanting portion 144 of elongated flat spring support 134 slants diagonally with respect to median plane 138, and the end of portion 144 that is nearer to opening 114 is closer to that plane than is the other end.

A second portion 146 of elongated spring support 132 slants diagonally with respect to median plane 138, with the end of portion 146 that is nearer to board-receiving opening 114 being farther from that plane. In the same way, second portion 148 of elongated spring member 134 slants diagonally with respect to median plane 138, with the end of portion 148 that is nearer to opening 114 being farther from the plane. In the embodiment of FIGS. 5–9, second slanting portions 146 and 148 are located at the free ends of spring members 132 and 134, respectively.

The purpose of slanting portions 142,144 and slanting portions 146,148 will be explained below.

The elements discussed so far are present in the board-operated electrical connector of this invention whether the members within the connector are all directly actuated, or whether some are directly actuated while others are indirectly actuated. The different structures of the electrical connector of these two types will now be described.

Direct Operation Of All Actuators Of The Connector

The Actuators

In the embodiment of the connector of this invention illustrated in FIGS. 5 through 9, actuator 150 for support 132 and actuator 152 for support 134 are both rigid pins formed of insulative material extending perpendicularly from carriage 154 in a direction transverse to their respective elongated supports. Pin 150 normally nests within, and contacts, slanting portions 142 and 146 (which are described above) of support 132 for first contact 116. Pin 152 bears the same relation to slanting portions 144 and 148 of support 134 for second contact 118.

In view of their described relationships to elongated supports 132 and 134, respectively, pins 150 and 152 are in a position to move (to the left in the Figures shown) against slanting portions 142 and 144 to urge the respective support means with which they are associated in a direction generally normal to median plane 138 and thereby move contacts 116 and 118, respectively, into their closed positions.

Movable Carriage As Operating Means

In addition to the other elements already described, the electrical connector of this invention includes means for operating the actuators such as actuator pins 150 and 152, which as just explained are positioned to depress supports 132 and 134, together with the contacts they support, downward toward their associated printed terminals on printed circuit board 70.

In the embodiment shown in FIGS. 5 through 9, the operating means is comprised of movable carriage 154 supporting both the actuator pins. Carriage 154 lies entirely outside the predetermined path 102 lying substantially perpendicular to leading board edge 78 (FIGS. 4 and 6) that is followed by printed circuit board 70 as it is inserted into the connector body and is moved to its position shown in FIG. 6. This position, as explained below, can be characterized as the "safe position" of the printed circuit board.

In the embodiment of the connector of this invention illustrated in FIG. 5, carriage 154 is positioned alongside elongated support means 132 and 134. Carriage 154 includes arm 156 immediately adjacent the two support means, and in addition abutment 158 extending from arm 156 into predetermined path 102 of printed circuit board 70. Abutment 158 is preferably located at a distance $d_6$ (seen in FIG. 6) from first contact 116 that is greater than distance $d_1$ but less than $d_2$, which distances are discussed above.

In FIG. 5, carriage 154 is slidably mounted in groove 160 in the inner surface of at least one main wall 110 of connector body 106.

In the embodiment shown, actuator pins 150 and 152 extend from one side only of movable carriage 154. If desired, the number of carriages 154 in the embodiment of FIG. 5 may be reduced by omitting every second carriage and mounting actuator pins on both sides of each remaining carriage, or even by omitting still more carriages and extending the length of each actuator pin to overlie several flat spring supports 132 or 134, as the case may be. In the latter case, the extended actuator pin can be secured at both ends to a movable carriage.

Operation Of Actuators and Supports In Embodiment Of FIGS. 6–9

The operation of actuator pins 150 and 152 can be seen from FIGS. 6 through 9.

In FIG. 6, as printed circuit board 70 moves from right to left along its predetermined path 102, front edge 78 of the board approaches abutment 158 of carriage 154, the means for operating the actuator pins.

Figure 7:
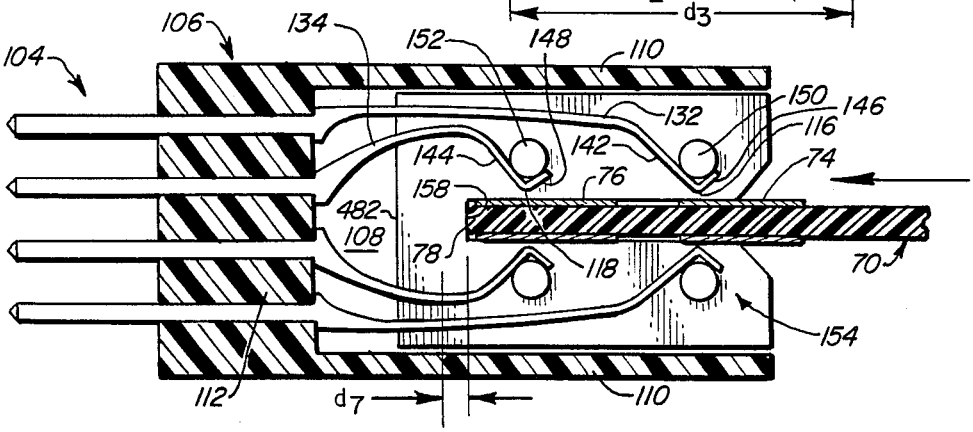
FIG. 7 is a similar view of the same connector, showing the printed circuit board in its ready position as it is being inserted in the connector body.

In FIG. 7, as printed circuit board 70 continues its movement from right to left, its leading edge 78 strikes abutment 158 and begins to move carriage 154 to the left. At this point, actuator pins 150 and 152 have not yet started to bend elongated, resiliently deformable metal spring members 132 and 134 downward, so that contact 116 and 118 are still in their open positions spaced from contacts 74 and 76, respectively.

Figure 8:
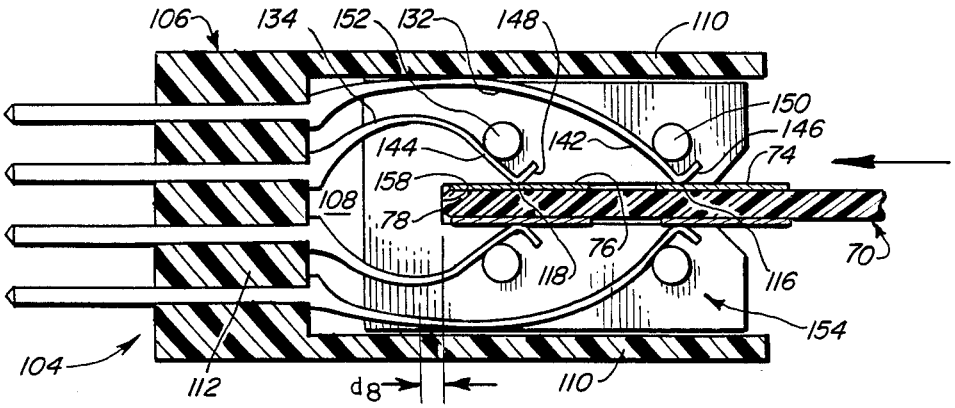
FIG. 8 is a similar view of the same connector, showing the printed circuit board in its initial contacting position as it is being inserted in the connector body.

In FIG. 8, printed circuit board 70 has moved a distance $d_7$ to the left after board leading edge 78 made its first contact with abutment 158 of carriage 154 (shown in FIG. 7). Since actuator pins 150 and 152 have moved with carriage 154 through the same distance $d_7$ to the left of the positions they occupied in FIG. 7, slanting portions 142 and 144 of supports 132 and 134, respectively, have been depressed to force contacts 116 and 118 into contact with their associated printed terminals.

Figure 9:
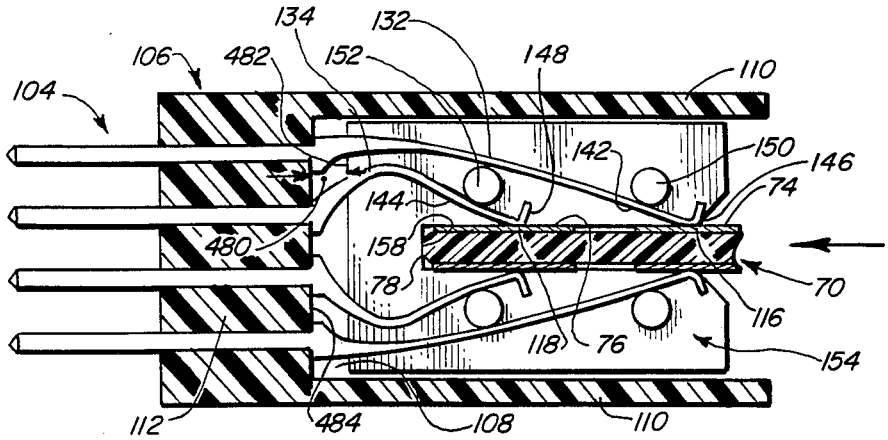
FIG. 9 is a similar view of the same connector, showing the printed circuit board after it has reached its fully operative position within the connector body.

In its position shown in FIG. 9, printed circuit board 70 has moved an additional distance $d_8$ to the left of the position it occupied in FIG. 8, and has carried carriage means 154 and actuator means 150 and 152 along with it. In this position, the pressing of the actuators against slanting portions 142 and 144 has further deformed supports 132 and 134, resepectively, and has pushed contacts 116 and 118 into their fully closed positions in full pressure contact with their associated printed terminals 74 and 76.

Three Elements In Working Portion Of Connector

To sum up, the working portion of the device of this invention includes a series of three elements —(1) resiliently deformable support means for each contact, (2) actuator means to push each support towards its associated printed terminal on the printed circuit board, and (3) operating means, against which the printed circuit board automatically pushes when the board is inserted into the connector body, to operate the actuator means—each of which is affected by the next succeeding element in a defined way during the operation of the device. Resiliently deformable supports 132 and 134, actuator pins 150 and 152, and carriage 154, respectively, are examples of the three elements referred to.

With suitable modifications of the deformable support means, actuator means, and operating means, other embodiments of the connector of this invention may be constructed, including among other forms connectors in which the printed circuit board is inserted in the connector body in a direction parallel to first row of contacts 74 and second row of contacts 76.

Two Of The Advantages Of The Connector Of This Invention

This description of the operation of the embodiment of FIGS. 6–9 emphasizes that among other advantages the electrical connector of this invention has the following two very important advantages, which have already been referred to above:

1. Printed circuit board 70 is inserted in connector 104 with very low insertion force. The only forces that need to be overcome when the printed circuit board moves from its position in FIG. 7 through its position in FIG. 8 to its final operative position in FIG. 9 are very small indeed.

These forces include (a) the slight frictional force to be overcome when movable carriage means 154 slides along groove 160 (FIG. 5), (b) the slight frictional force to be overcome as the actuator pins slide along the first slanting portions of their associated elongated flat spring supports, (c) the resistance of the elongated supports to downward bending, and (d) the frictional force between the contacts and printed terminals 74 and 76 as the contacts slide along the terminals. Obviously the sum of all these forces is quite small.

2. As first contact 116, for example, makes initial contact with printed terminal 74 of printed circuit board 70 (FIG. 8) and then slides along the printed terminal as the circuit board is moved farther into connector 104, a small but effective wiping action takes place. The wiping action is sufficient to scrape through any layer of oxide that may have formed on either contact 116 or printed terminal 74.

Function of Slanting Portions of Supports

The operation of embodiment 104 of the electrical connector of this invention just described by reference to FIGS. 6–9 makes clear the function performed by first slanting portions 142 and 144 of elongated, flat spring supports 132 and 134, respectively.

First slanting portion 142, for example, has three functions:

When actuator pin 150 pushes (from right to left in FIG. 6) against the inclined plane provided by first slanting portion 142, the actuator applies a force normal to that plane that has a component directed vertically downward toward median plane 138 of connector body 106. Since support 132 is deformable, this downward force depresses member 132 and moves first contact 116 carried by that member down in the same direction, to bring the contact into contact with its associated printed terminal 74.

When printed circuit board 70 is removed from connector 104 (as will be described below), the potential energy stored in resiliently deformable support 132 is utilized to assist in the removal of the board from the connector. The situation is now reversed from what it was when the board was being inserted in connector 104, with first slanting portion 142 of the deformed flat spring support now pressing against actuator 150 in a direction normal to the inclined plane of that portion of the support. Since this force has a horizontal component directed to the right, it will tend to push carriage 154 in that direction by keeping abutment 158 in contact with board edge 78, which will in turn help to push printed circuit board 70 out of connector body 106 when any retaining device employed is released.

The force exerted by deformed resilient flat spring 132 as it returns to its normal shape has another advantage, for the upwardly directed vertical component of that force assures that contact 116 will be moved back up to its normal open position, so that it will not make any contact with printed terminal 76, but will remain spaced above that terminal, as the printed circuit board is removed from connector 104.

Second slanting portion 146 of support 132, for example, has the following function:

When printed circuit board 70 is being removed from electrical connector 104 and has moved to the right to the position illustrated in FIG. 7, it will be seen that from that point on leading edge 78 of board 70 is no longer in contact with abutment 158 and thus no longer acts to confine movable carriage 154 within the connector body. At this juncture, second slanting portion 146 takes pver, and helps to restrain carriage 154 from sliding out of the connector body. Actuator 150 nests in the V-shaped element formed by first slanting portion 142 and second slanting portion 146, thereby holding the actuator, and the carriage on which it is supported, in the desired position for re-insertion of the printed circuit board.

Operation Of Other Actuators And Supports

Direct operation of all actuators can be achieved with still other arrangements of contacts, supports and actuators besides the arrangement illustrated in FIGS. 5–9. Some of these are illustrated in the drawing of this application and will now be described.

Figure 10:
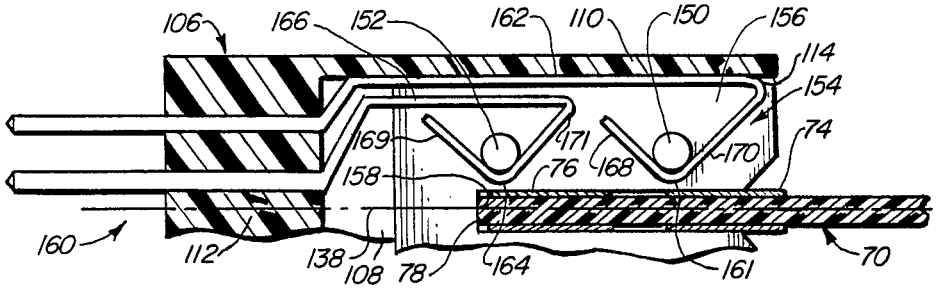
FIG. 10 is a fragmentary sectional view of another embodiment of the electrical connector of this invention, showing the printed circuit board after it has been inserted within the connector body to its ready position.

FIG. 10 is a fragmentary sectional view of another embodiment 160 of the electrical connector of this invention, showing printed circuit board 70 having been inserted in connector body 106 sufficiently far that leading edge 78 of the board has contacted abutment 158 of carriage 154, putting the connector in the same condition as shown in FIG. 7 for the embodiment shown in that Figure and discussed above. In the embodiment shown in FIG. 10, first contact 161 is supported by elongated, resiliently deformable flat spring 162 and second contact 164 is supported by elongated, resiliently deformable flat spring 166.

First slanting portion 168, located at the free end of support 162, has its end that is nearer to board-receiving opening 114 closer to median plane 138. When printed circuit board 70 is inserted farther into connector body 106 towards the left in FIG. 11, actuator pins 150 and 152 are also moved to the left along with carriage 154. The actuator pins then cause slanting portions 168 and 169 to be depressed, which bends supports 162 and 166 downward and causes contacts 161 and 164, respectively, to be pressed against their associated printed terminals 74 and 76.

Figure 11:
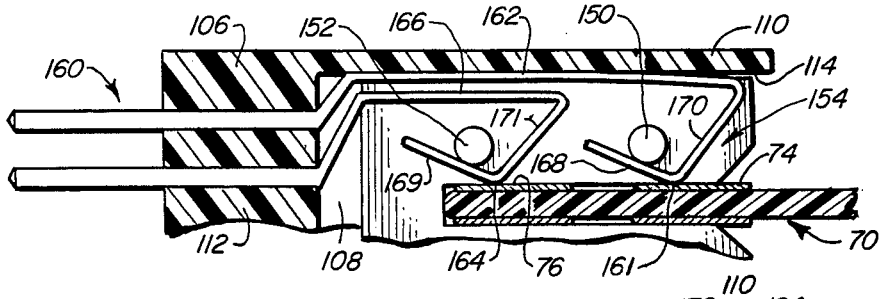
FIG. 11 is a similar showing of the same embodiment of the electrical connector of this invention with the printed circuit board having been inserted within the connector body to its initial contacting position.

As can be seen, the over-all length of flat spring support 162 in the embodiment of FIGS. 10 and 11 is longer than the over-all length of support 132 in FIGS. 5–9. This longer length will tend to produce less fatigue in the flat spring metal strip of which the elongated supports are formed, and should lead to a longer life for these members, especially if the connector is used with a system in which printed circuit boards are frequently inserted in, and retracted from, the connector.

Another advantage of this embodiment is the fact that second slanting portions 170 and 171 provide an obstacle barring movement of carriage 154 out of connector body 106.

Figure 12:
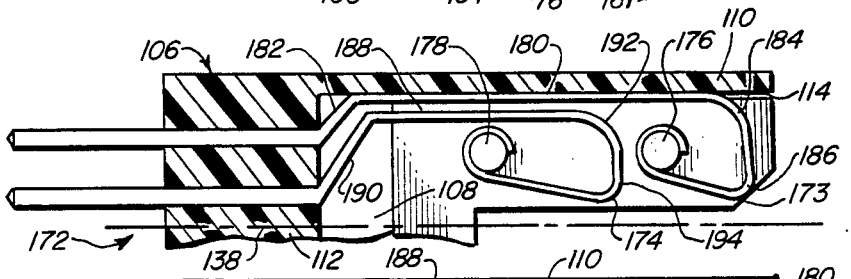
FIG. 12 is a fragmentary sectional view of another embodiment of the electrical connector of this invention, showing the contacts in the positions they occupy before the printed circuit board has been inserted in the connector body.

FIG. 12 is a fragmentary sectional view of another embodiment 172 of the electrical connector of this invention, showing first contact 173 and second contact 174 in the positions they occupy before the printed circuit board has been inserted within connector body 106. (The printed circuit board is omitted from this Figure and from FIG. 13 for simplicity.) In this embodiment, first actuator 176 and second actuator 178 do not press against an inclined portion of the elongated, resiliently deformable supports for contacts 173 and 174, but by moving to the left produce a bending stress that pulls the contacts down against their associated printed terminals.

Flat spring 180 extends from its base portion 182 to first location 184 nearer to board-receiving opening 114 than is actuator pin 176. Support 180 then extends from location 184 in a direction downward towards median plane 138 to second location 186, approximately at the location of contact 173. Support 180 then extends from location 186 back to actuator pin 176, to which the free end of the support is secured, preferably with a slip fit.

Support 188 for actuator pin 178 extends in a similar way from its base portion 190 to location 192, and from there in the direction of median plane 138 to location 194 and back again to the actuator pin 178, to which it is secured, preferably with a slip fit.

Figure 13:
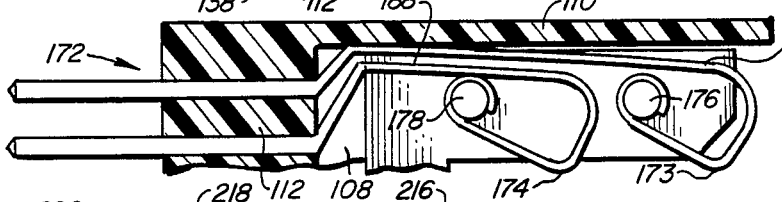
FIG. 13 is a similar view of the embodiment of FIG. 12, showing the contacts in the positions they would occupy if the printed circuit board is not inserted within the connector body but the carriage means and the actuator pins carried by it are moved to the left in the Figure.

Movement of actuator pins 176 and 178 to the left in FIG. 13 applies a bending stress to both elongated, flat spring supports 180 and 188 to move contacts 173 and 174, respectively, into positions shown in FIG. 13 which would bring them into full pressure contact with their associated printed terminals if the printed circuit board (omitted from FIGS. 12 and 13 for simplicity) were present within connector body 106.

Connector With Three Rows Of Contacts

Figure 14:
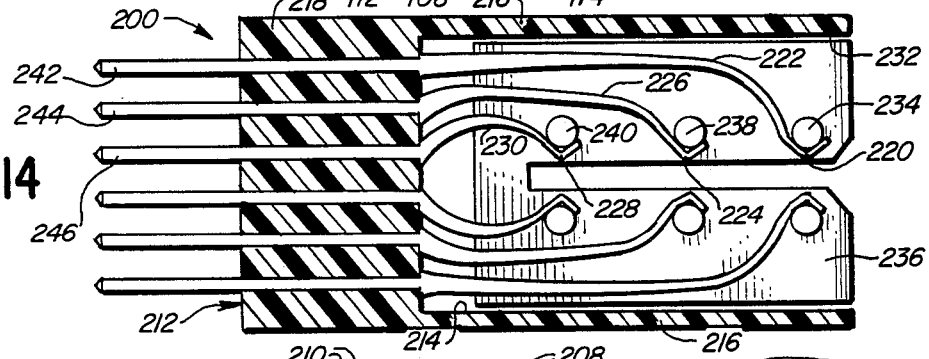
FIG. 14 is a sectional view of another embodiment of the electrical connector of this invention in which there are three rows of contacts within the connector body.
Figure 15:
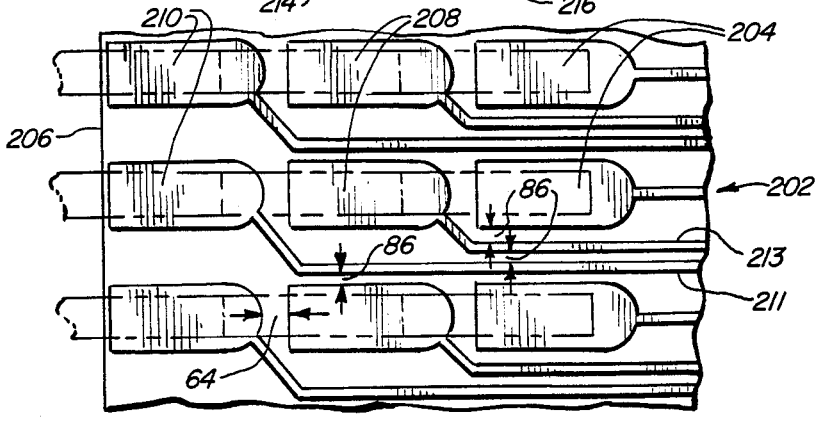
FIG. 15 is a plan view similar to FIG. 3 of a portion of a printed circuit board having three rows of printed terminals along the leading edge of the printed circuit board.
Figure 18:
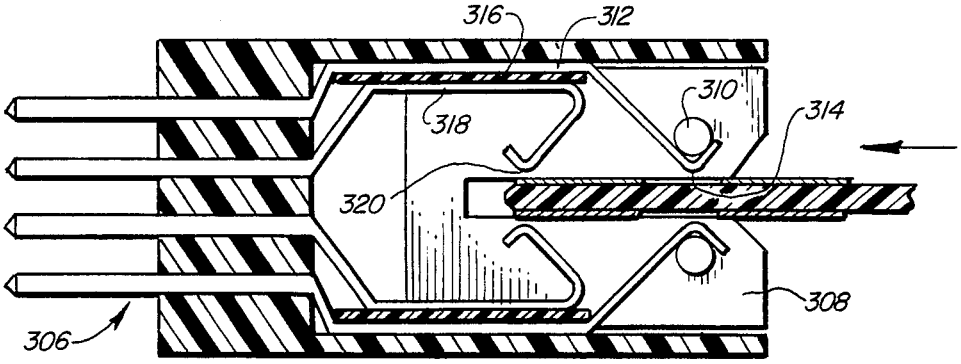
FIG. 18 is a sectional view of another embodiment of the connector of this invention, in which the actuator means for the first contact is directly operated and the actuator for the second contact is indirectly operated, showing the printed circuit board in its safe position as it is being inserted into the connector body.
Figure 19:
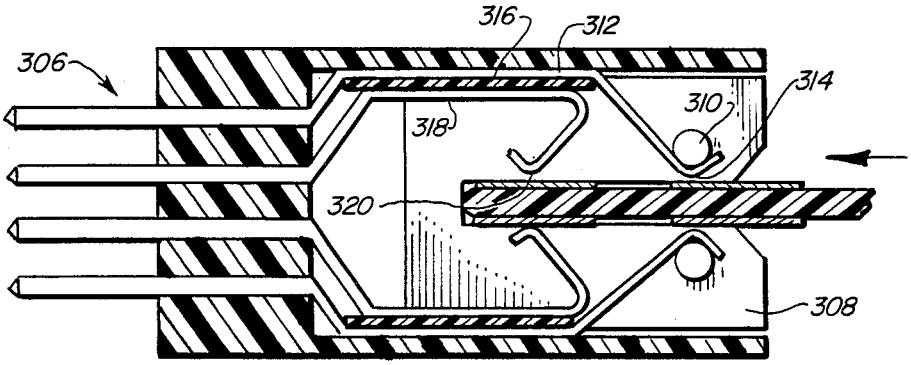
FIG. 19 is a similar view of the same connector, showing the printed circuit board in its ready position as it is being inserted in the connector body.
Figure 20:
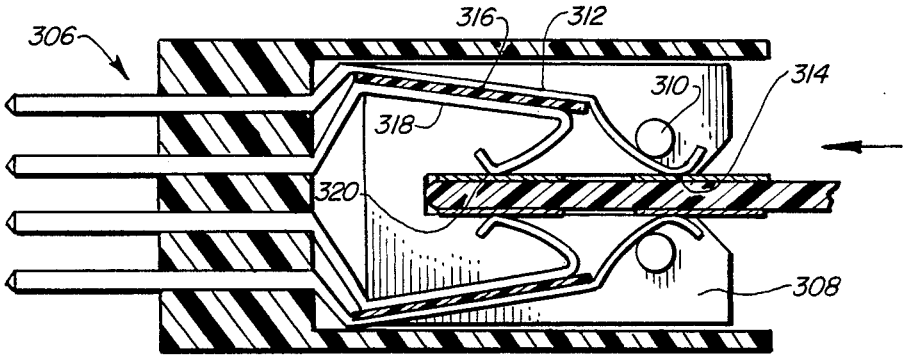
FIG. 20 is a similar view of the same connector, showing the printed circuit board in its initial contacting position as it is being inserted in the connector body.
Figure 21:
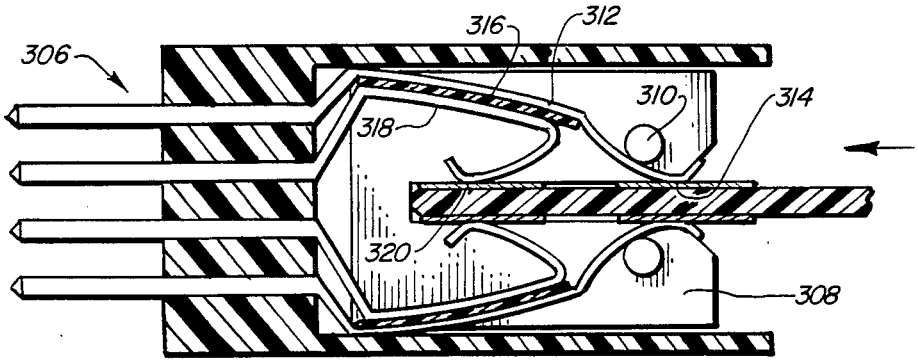
FIG. 21 is a similar view of the same connector, showing the printed circuit board after it has reached its fully operative position within the connector body.

FIG. 14 is a sectional view of another embodiment 200 of the electrical connector of this invention in which there are three rows of contacts within the connector body, both above and below the printed circuit board. FIG. 15 is a plan view similar to FIG. 3 of a portion of a printed circuit board 202 that is of a type that can be used with the embodiment of FIG. 14. (For clarity, the printed terminals in FIG. 15 are more widely spaced than they would be if the circuit board there was actually used with connector 200 of FIG. 14.)

In printed circuit board 202, first terminals 204 are located farthest from edge 206 of the board, and second terminals 208 lie between terminals 204 and board edge 206. A third row of additional similar printed terminals 210 is disposed parallel to and immediately adjacent board edge 206, between that edge and rows of printed terminals 204 and 208.

As will be seen from FIG. 15, this arrangement of printed terminals further increases the density of the terminals on the printed circuit board. The required minimum spacing 64 between adjacent printed terminals and the required minimum spacing 86 between the printed terminals and their leads (both of which are discussed above in connection with FIG. 3) are maintained in printed circuit board 202. The resulting pattern increases the density of printed terminals for a given area of the printed circuit board to about $2\frac{1}{2}$ times the density shown in the prior art circuit board of FIG. 1. (The density is not increased to 3 times, as might have been expected, because of the additional space required for lead 211 from the third terminal 210 shown in FIG. 15, and the extra space required between that lead and lead 213 from middle terminal 208.)

In FIG. 14, connector body 212 of electrical connector 200 contains within interior 214 (defined by main walls 216 and narrow walls 218) members that are of a similar type to the elements contained in embodiment 104 of this connector illustrated in FIGS. 5–9.

First contact 220 is integrally formed with elongated, resiliently deformable support 222. Similarly, second contact 224 is integrally formed with its elongated flat spring support 226, and additional contact 228 is similarly formed with its flat spring support 230. Contact 220 lies nearest to board-receiving opening 232, second contact 224 lies next nearest to the opening, and third contact 228 is most remote from the opening. First contact 220 is electrically connected with output lead 242, second contact 224 with output lead 244, and third contact 228 with output lead 246.

Actuator 234 associated with first contact 220 is perpendicularly mounted on carriage 236, as are actuators 238 and 240 for second contact 224 and third contact 228, respectively. Carriage 236 is the operating means for all three actuators 234, 238 and 240.

Contacts Arranged Perpendicular To Leading Edge Of Printed Circuit Board

FIG. 16 gives a schematic showing in a fragmentary perspective view of electrical connector 250 according to this invention, for use with a printed circuit board 252 (shown in the Figure in phantom) that has four or more printed terminals disposed in a column along sliding edge 254, which is perpendicular to leading edge 256 of the board.

When board 252 is inserted in the connector body as indicated in FIG. 16, it follows predetermined path 258, also perpendicular to edge 256.

First contact means 260, second contact means 262, third contact means 264 and fourth contact ments 266 are disposed adjacent sliding edge 254 of printed circuit board 252.

Contact 260 is supported by elongated flat spring member 268 and is electrically connected with output lead 270. Actuator pin 272, extending perpendicularly from carriage or operating means 274, is associated with contact 260. The other contacts, supports, and actuators are similarly arranged.

Indirect Operation Of Some Actuators

In the embodiments of this invention so far discussed, the operating means, such as a movable carriage, operates the actuators for all the contacts of the connector directly. In other embodiments of the connector of this invention, if desired the operating means operates a given one of the actuators directly and the operation of that given actuator results indirectly in the operation of the other actuator or actuators.

Movable Carriage As Operating Means

FIG. 17 is a broken away perspective view of such an embodiment 280 of the connector of this invention.

In this embodiment, first contact 282 is integrally formed with elongated, flat spring support 284, and has associated with it actuator pin 286. Second contact 288 is integrally formed with elongated flat spring support 290, in a manner similar to the construction of electrical connectors 104, 160, 172 and 200 already described, but has no actuator associated with it in the form of a pin mounted on a movable carriage.

In connector 280, the actuator means for flat spring support 290 for second contact 288 is layer 292 of insulative material that is positioned between and in contact with the base portions of support 284 for first contact 282 and support 290 for the second contact.

As will be seen from FIG. 17, actuator pin 286 for first contact 282 is located within interior 294 of connector body 296 in a position exposed to the application of translational force by carriage 298 in automatic response to the insertion of a circuit board in board-receiving opening 300 and movement of the board (to the left in FIG. 17) until its leading edge strikes abutment 302.

Elongated flat spring supports 284 and 290 are disposed and arranged so that movement of support 284 in a direction normal to median plane 304 of connector body 296 causes movement of support 290 in a similar direction. When translational force is applied to actuator pin 286 from right to left in FIG. 17, that actuator presses against support 284 to move it and contact 282 in a direction generally normal to median plane 304 into initial contact with its associated printed terminal on the printed circuit board that has been inserted in connector 280.

At the same time, through the described movement of support 284, pin 286 causes actuator/insulator 292, in turn, to press in a direction generally normal to the median plane 304 against support 290, to bring second contact 288 also into initial contact with its associated printed terminal. Actuator pin 286 is thus operated directly, while actuator 292 is operated indirectly.

In this embodiment, flat spring support 284 for contact 282 is spaced farther from median plane 304 than is flat spring support 290 for second contact to 288. It also is located in position adjacent to and overlying support 290.

If desired, second contact 288 may have an actuator that is directly operated and the actuator for first contact 282 may be indirectly actuated. In such case, second contact 288 may have an actuator pin that is exposed to application of translational force by carriage 298, so that it is support means 290 for the second contact that is directly pressed toward median plane 304. In such case, longer resiliently deformable support 284 can be pulled downward toward median plane 304 by an insulative connector (such as a rivet or stud formed of insulative material) between lower spring member 290 and upper spring member 284.

Other Embodiments With Indirect Operation Of One Actuator

FIGS. 18–21 show another embodiment 306 of the electrical connector of this invention, in which one actuator is directly operated and the other is indirectly operated.

In this embodiment, carriage 308 applies translational force to actuator pin 310 supported by the carriage, which depresses elongated, flat spring support 312 associated with first contact 314. This, in turn, depresses actuator/insulator 316 located between flat spring support 312 and elongated, flat spring support 318 for second contact 320. Support member 312 presses downward against actuator/insulator 316, which thus presses against support 318 and brings contact 320 into its closed position against its associated printed terminal.

Figure 22:
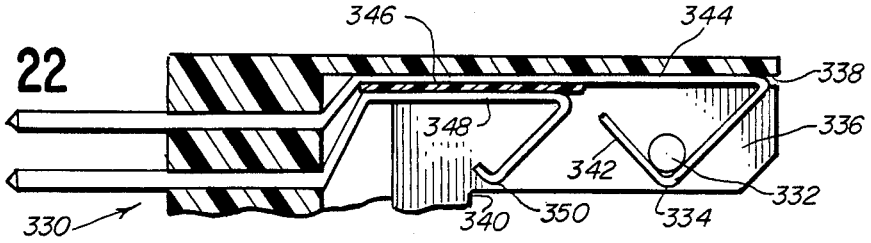
FIGS. 22 and 24 are fragmentary sectional views of other embodiments of the electrical connector of this invention, in which the actuator means for the first contact is directly operated and the actuator for the second contact is indirectly operated.

FIG. 22 is a fragmentary sectional view of another embodiment 330 of the electrical connector of this invention in which the actuator means for one contact is directly operated and the actuator for the other contact is indirectly operated.

Figure 23:
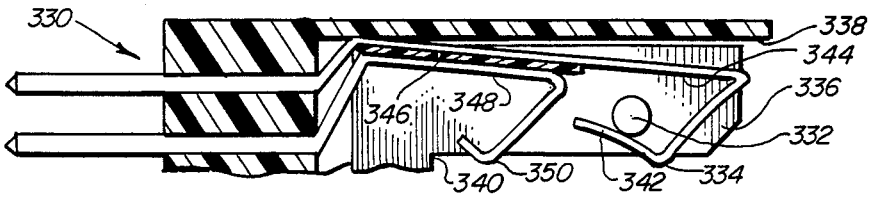
FIGS. 23 and 25 are views similar to FIG. 13 of the embodiments of FIGS. 22 and 24, respectively.

Actuator pin 332 for first contact 334 has translational force applied to it by carriage 336 as the carriage is moved to the left in this Figure when a printed circuit board is inserted in board-receiving opening 338 and its leading edge strikes abutment 340 of the carriage. As seen in FIG. 23, actuator 332 pushes against slanting portion 342 of elongated, flat spring support 344 to press first contact 334 downward into its closed position.

At the same time, flat spring support 344 presses down against actuator/insulator 346 to indirectly press elongated, flat spring support 348 downward and bring second contact 350 into its closed position in contact with its associated printed terminal.

Figure 24:
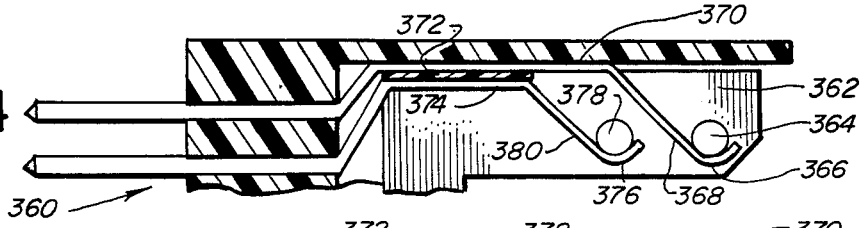

FIG. 24 is a fragmentary sectional view of another embodiment 360 of the electrical connector of this invention, in which indirect operation of one actuator means is supplemented by direct operation of the same actuator. As carriage 362, moving to the left in FIG. 24, applies translational force to actuator pin 364 for first contact 366, pin 364 presses down on slanting portion 368 of elongated, flat spring support 370 to bring contact 366 to its closed position in contact with its associated printed terminal.

Figure 25:
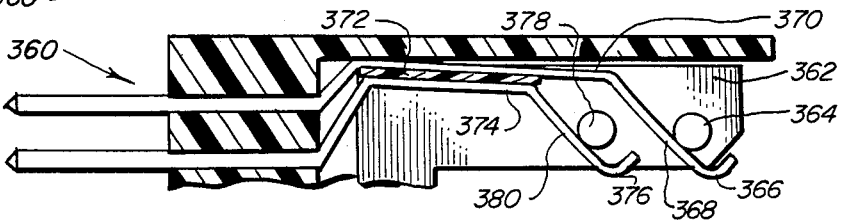

At the same time, elongated support 370 presses down on actuator/insulator 372, which presses downward against elongated, flat spring support 374 associated with second contact 376. This downward movement is supplemented by downward pressure from actuator pin 378 on slanting portion 380 of support 374. As seen in FIG. 25, first contact 366 and second contact 376 are thus both moved into their closed positions for contact with their associated printed terminals.

Hood As Actuator In Indirect Operation Of Some Actuators

Figure 26:
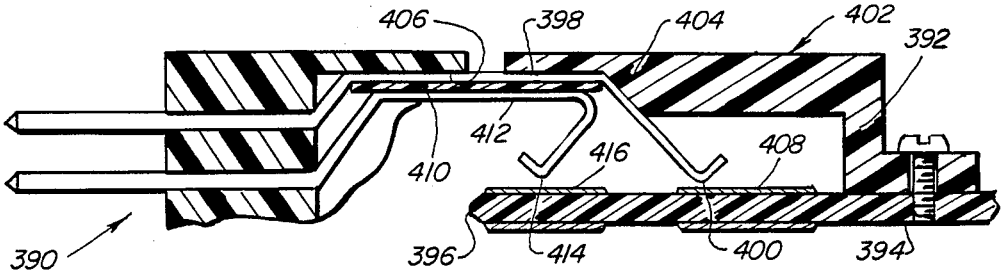
FIG. 26 is a fragmentary sectional view of another embodiment of the electrical connector of this invention showing the printed circuit board in its ready position, in which embodiment the actuator for the first contact is directly operated and the actuator for the second contact is indirectly actuated.

FIG. 26 is a fragmentary sectional view of another embodiment 390 of the connector of this invention, in which the actuator for the first contact is directly operated and the actuator for the second contact is indirectly operated. In this embodiment, the operating means is comprised of post means 392 mounted on printed circuit board 394, adjacent first edge 396 of the board, in such a manner as not to interfere with the printed terminals or with the circuitry that leads to those terminals. The actuator for elongated, flat spring 398 associated with first contact 400 is hood 402 mounted on post means 392, with its edge portion 404 spaced from and overlying the printed terminals on the circuit board.

Figure 27:
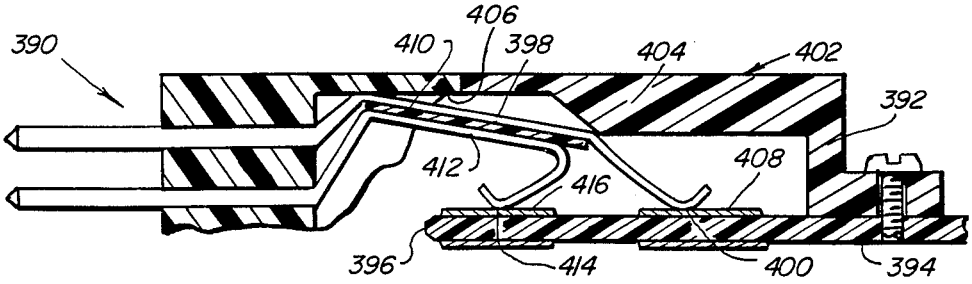
FIG. 27 is a similar view of the same connector, showing the printed circuit board after it has reached its fully operative position within the connector body.

As shown in FIG. 27, when board 394 is inserted in board receiving opening 406 and moved to the left to its fully operative position, hood edge portion 404 applies actuating force to flat spring support 398 to press contact 400 into its closed position against its associated printed terminal 408.

At the same time, flat spring support 398 presses down on actuator/insulator 410 (located between elongated supports 398 and 412), which in turn presses elongated, flat spring support 412 down and moves its associated second contact 414 into its closed position against printed terminal 416.

Three Rows Of Contacts With Some Indirect Operation

Figure 28:
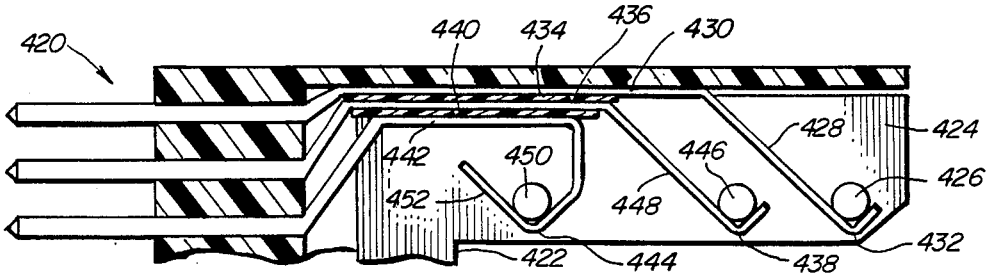
FIG. 28 is a fragmentary sectional view of another embodiment of the electrical connector of this invention in which there are three rows of contacts within the connector body, and in which the actuator means for the first contact is directly operated and the actuator means for the second and third contacts are both directly and indirectly operated.

FIG. 28 is a fragmentary sectional view of another embodiment of the electrical connector of this invention including three rows of contacts, in which the actuator for the first contact is directly operated and the actuators for the second and third contacts are indirectly operated, with the second and third actions being supplemented by direct operation.

When the leading edge of a printed circuit board presses against abutment 422 of carriage 424, actuator pin 426 supported on the carriage presses against first slanting portion 428 of elongated, flat spring support 430 for first contact 432. This causes support 430 to be depressed as carriage 424 moves farther to the left, and brings contact 432 into its closed position in contact with its associated printed terminal on the printed circuit board.

At the same time, support 430 presses down against actuator/insulator 434, which depresses elongated flat spring support 436 for second contact 438 and brings that contact into contact with its associated printed terminal on the circuit board. In turn, support 436 presses down against actuator/insulator 440, which presses support 442 down and brings third contact 444 into its closed position in contact with its associated printed terminal on the circuit board.

While this is taking place, actuator pin 446 presses against first slanting portion 448 of support 436 to supply a supplementary downwardly directed force urging contact 438 against its associated printed terminal. Likewise, actuator 450 presses against slanting end portion 452 of elongated, flat spring support 442 to supplement with direct actuation the indirectly actuated downward force urging third contact 444 into contact with its printed terminal.

Four Positions Of Printed Circuit Board Within Connector Body

All the embodiments of the board-actuated electrical connector of this invention that have been described operate in the same basic way.

Means are provided in each embodiment (such as the above described movable carriage or hood) for operating actuator means in automatic response to the insertion of the printed circuit board in the board-receiving opening of the connector body and movement of the board along a predetermined path within the connector body for certain defined distances. As the board is inserted and moved in the manner described, it takes four successive positions with respect to the first contact of the connector, and the connector responds in certain defined ways to achieve the advantages of this invention.

The four positions that are automatically taken by the printed circuit board during insertion of the board into the electrical connector of this invention will be described for the embodiment disclosed in FIGS. 5–9 of the drawing. The other embodiments disclosed in this application operate in the same basic way.

Safe Position

FIG. 6 shows how electrical connector 104 avoids the problem of unwanted contacts, such as between first contact 116 and second printed terminal 76 on printed circuit board 70, when the board is inserted in the connector body. Specifically, FIG. 6 shows the "safe position" taken in passing by printed circuit board 70 as it moves from right to left as indicated in the drawing, in which position first edge 78 of the circuit board has moved along predetermined path 102 of the circuit board beyond first contact 116 a distance greater than distance $d_5$ but less than $d_1$.

As explained above, $d_5$ is the distance from board edge 78 to the most remote boundary of printed terminal 76, and distance $d_1$ is the distance from edge 78 to the boundary of printed terminal 74 on board 70 that is nearest the edge. Thus, in the illustrated safe position, first edge 78 of printed circuit board 70 has moved past both first contact 116 and second contact 118, second printed terminal 76 has moved beyond first contact 116, but first printed terminal 74 has not yet reached its associated first contact 116.

The result in this safe position of the printed circuit board is that first contact 116 temporarily occupies a position between printed terminals 74 and 76, beyond second printed terminal 76 but short of first printed terminal 74. Moreover, because first contact 116 is normally in its open position with gap 135 between it and the plane of the top surfaces of printed terminals 74 and 76, the contact has reached the indicated position between terminals 74 and 76 without making any contact with second printed terminal 76.

As will be seen, the construction of electrical connector 104 guarantees that first contact 116 will not make unwanted contact with second printed terminal 76, since carriage 154 is not caused to move to the left until after leading board edge 78 has come into contact with carriage abutment 158 (FIG. 7) and has moved beyond that point. This means that, as seen in FIG. 6, first contact 116 remains spaced above printed circuit board 70 until second printed terminal 76 nearer board edge 78 is safely past first contact 116, located nearer board-receiving opening 114 of connector 104.

Ready Position

When printed circuit board 70 reaches the position shown in FIG. 7, it has moved enough to the left that first printed terminal 74 lies beneath first contact 116 and second printed terminal 76 lies beneath second contact 118. At this juncture, the circuit board has moved along its predetermined path within the interior of the connector body until its first edge 78 has moved beyond first contact 116 a distance greater than distance $d_1$ but less than distance $d_2$.

At this point, the board occupies a "ready position," in which first printed terminal 74 has been brought to a position adjacent and spaced below first contact 116. First contact 116, in other words, is ready to be pressed downward into its closed position in contact with its associated first printed terminal 74, and at the same time second contact 118 is ready to be pressed downward into its closed position in contact with its associated second printed terminal 76.

Initial Contacting Position

When printed circuit board 70 has pushed carriage 154 and actuators 150 and 152 supported by the carriage to the left into the position shown in FIG. 8, first contact 116 and second contact 118 have been pushed downward into their closed positions in contact with their associated first printed terminal 74 and second printed terminal 76, respectively. In this position, circuit board 70 may be said to be in its "initial contacting position."

Board 70 reaches its initial contacting position when circuit board first edge 78 has moved beyond first contact 116 a distance greater than first predetermined distance $d_1$, but less than third predetermined distance $d_3$. At these distances, since distance $d_1$ is the distance the boundary of first printed terminal 74 that is nearest board edge 78 lies from that edge and distance $d_3$ is the distance that the boundary of terminal 74 most remote from edge 78 lies from the edge, first contact 116 makes contact with its associated first printed terminal 74.

The preferred position of printed circuit board 70 when it is in its initial contactng position is one in which first edge 78 of the circuit board has moved beyond first contact 116 a distance greater than distance $d_1$ but less than distance $d_2$.

Fully Operative Position

FIG. 9 shows the operation of electrical connector 104 when printed circuit board 70 has proceeded to its "operative position" within connector body 106. In this position, actuator means 150 and 152 have moved their respective first contact 116 and second contact 118 into their fully closed positions in full pressure contact with their associated first printed terminal 74 and second printed terminal 76 on the printed circuit board.

At this juncture, first edge 78 of the circuit board has moved beyond first contact 116 a distance approximately equal to second predetermined distance $d_2$ and less than distance $d_3$. Distance $d_2$ is the distance of the geometric center of printed terminal 74 from first board edge 78.

It is essential that the electrical connector of this invention be constructed so that the printed circuit board passes through the defined safe position and into the defined initial contacting position. In the preferred form of the invention, the printed circuit board also passes through the defined ready position and into the defined fully operative position.

Latch/Delatch Mechanism

As seen from FIGS. 6–9, if the process illustrated there is reversed and printed circuit board 70 is withdrawn (to the right in those Figures) from its operative position past its initial contacting position, the contact between the contacts of the connector and their associated printed terminals will be broken.

To avoid inadvertent movement of the printed circuit board out of the connector and the resulting undesired breaking of the contacts, it is preferred to provide means to hold the board in its operative position within the connector body after it has been placed in that position by the user of the connector. The holding means should of course be selectively releasable by the user of the connector. FIGS. 29–37 show such a holding means.

General Construction Of Latch/Delatch Mechanism

Figure 29:
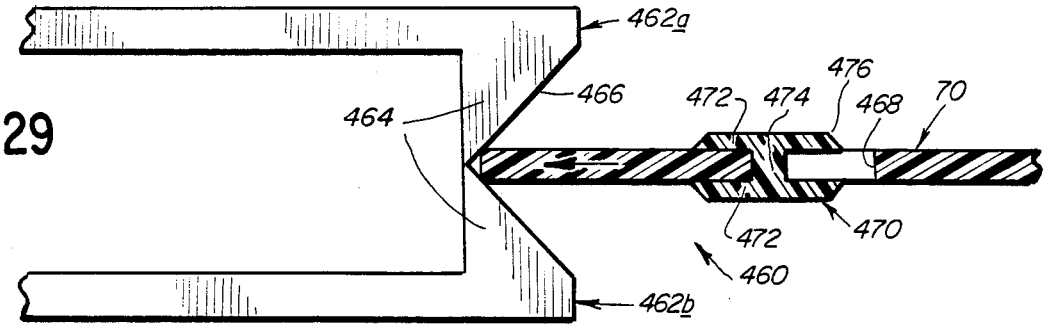
FIG. 29 is a fragmentary side view, partly in section of one embodiment of a latch/delatch mechanism that can be used with the connector of this invention, with a printed circuit board shown as it is about to be inserted in the mechanism.

FIG. 29 is a side view, partly in section, of one embodiment of a latch/delatch mechanism 460 that can be used with the connector of this invention. In this Figure, printed circuit board 70 is shown as it is about to be inserted in mechanism 460.

Elongated, resiliently deformable pawl means **462*a* and 462*b* may be secured (as indicated in FIG. 4) at their base portions to connector body 90**. Alternatively, the pawls may be secured to the cage in which the printed circuit board is retained, or to the back plane on which the connector is mounted, or to any other fixed member of the structure to which the connector is secured.

Pawl **462*a* and pawl 462*b* are similarly constructed and face each other, as shown in FIG. 29**, from opposite sides of the space that is occupied by the printed circuit board when it is inserted in the connector. If desired, only one pawl may be employed, if it is suitably shaped and suitably positioned with respect to the printed circuit board.

As exemplified in pawl **462*a* each pawl carries hook portion 464 at its free end, normally biased in a closed position. The outer end of hook 464 comprises inclined surface 466 adjacent and facing printed circuit board 70 when the board is in position (as shown in FIG. 29**) to be inserted between the two pawls.

Figure 37:
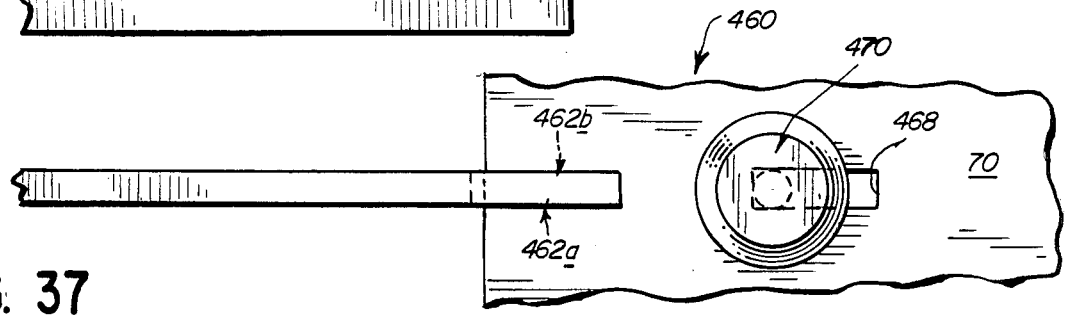
FIG. 37 is a top plan view of the same latch/delatch mechanism in the condition shown in FIG. 36.

As a part of the combination that comprises latch/delatch mechanism 460, printed circuit board 70 defines elongated slot 468 extending, as will be seen in FIG. 37, longitudinally of pawls **462*a* and 462*b*. In their biased, normally closed conditions, hook portions 464 are positioned within slot 468 in the relationship shown in FIG. 32**.

Included in latch/delatch mechanism 460 is plug member 470, which is slidably confined in elongated slot 468. Plug 470 remains confined in the slot because it comprises two button-shaped members 472 joined by a post 474 that slides within the slot. Each button 472 of plug 470 has an outer face 476 that is remote from printed circuit board 70, and is formed to permit inclined surface 466 of pawl 464 to slide up on the surface in a manner to be described below.

Insertion Of Printed Circuit Board Within Latch/Delatch Mechanism

Figure 30:
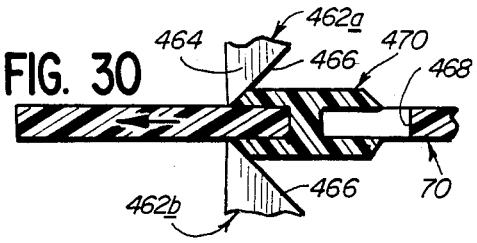
FIGS. 30–32 are fragmentary side views of the latch-/delatch mechanism of FIG. 29, showing successive stages of the insertion of a printed circuit board within the mechanism until it operates to retain the printed circuit board.
Figure 33:
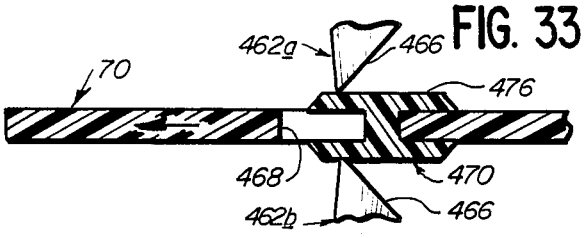
FIGS. 33–35 are siimilar views showing successive stages of the release of the printed circuit board from the latch/delatch mechanism.
Figure 31:
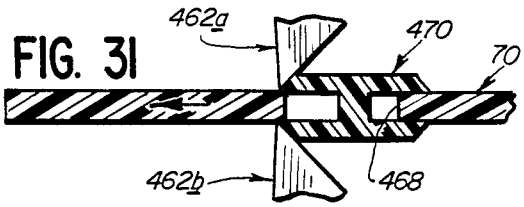
Figure 32:
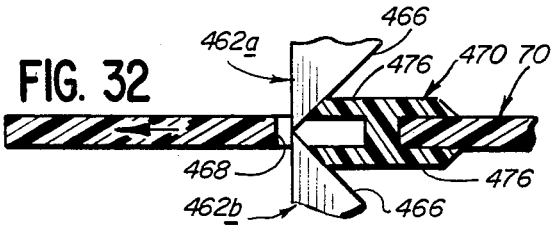

FIGS. 29–32 illustrate how printed circuit board 70 is inserted between pawls **462*a* and 462*b*, and is then pushed forward until the pawls respond to their normal bias and drop into slot 468 (as seen in FIG. 32). In this condition, latch/delatch mechanism 460 retains printed circuit board 70** in its operative position in the connector body.

In FIG. 30, printed circuit board 70 has moved far enough to the left that inclined surface 466 of pawl **462*a* just strikes slidable plug 470. In FIG. 31, pawl 462*a* has slid plug 470 to the right, just beyond the center of elongated slot 468**.

As seen in FIG. 32, when plug 470 has slid all the way to the right in the slot, pawls **462*a* and 462*b* drop into slot 468**, where they will retain the board within the electrical connector.

Removal Of Printed Circuit Board From Latch/Delatch Mechanism

FIGS. 33–37 illustrate the steps by which printed circuit board 70 may be removed from latch/delatch mechanism 460 whenever desired by the user of the connector.

As will be seen from FIG. 9, when printed circuit board 70 is in its fully operative position within connector 104, a substantial distance 480 remains between leading edge 482 of movable carriage means 154 and inner wall 484 of interior 108 of connector body 106. When it is desired to remove the printed circuit board from the connector, the first step is to push the board (to the left in FIG. 9) into the space between carriage 154 and inner wall 484.

When this is done, pawls **462*a* and 462*b* move to the right from their positions shown in FIG. 32, as inclined surfaces 466 slide up on surface 476 of plug 470. As the movement of the printed circuit board to the left in FIG. 33 beyond the board's operative position within the connector body presses slidable plug 470 against inclined surfaces 466, pawls 462*a* and 462*b* are caused to bend outward away from the circuit board and slide up on surface 476** as just described.

Figure 34:
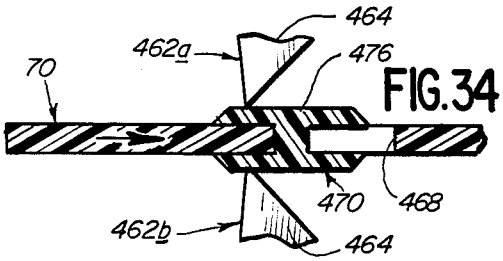

When the pawls have slid onto outer faces 476 of the plug, the friction between hooks 464 on the two pawls and plug outer surface 476 will keep these two members engaged while the printed circuit board is being withdrawn from the connector body, which is the next step as illustrated in FIG. 34.

Figure 35:
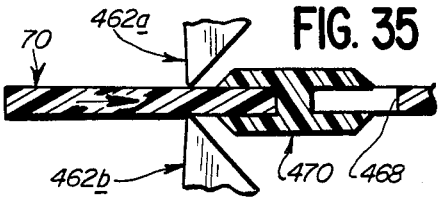

As seen in the latter Figure, plug 470 slides from the right end of elongated slot 468 to the left end as the printed circuit board is pulled out of the connector to the right in that Figure. When the circuit board is pulled still farther to the right, pawls **462*a* and 462*b* slide down off plug 470, as seen in FIG. 35, when it continues to move to the right as urged by the left-hand end wall of slot 468**.

Figure 36:
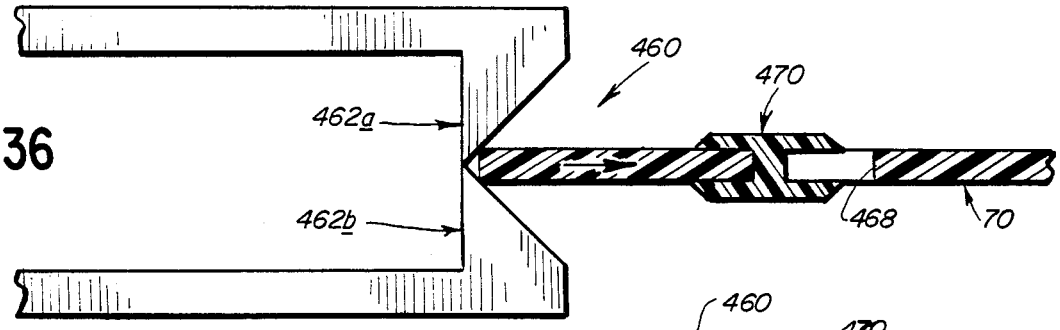
FIG. 36 is a similar view of the latch/delatch mechanism of FIG. 29 at the moment the printed circuit board is fully released from the latch/delatch mechanism.

Finally, as seen in FIG. 36, printed circuit board 70 is pulled completely out from between pawls **462*a* and 462*b*, which are then free to resume their normally closed position. FIG. 37 is a top plan view of latch- /delatch mechanism 460 showing plug 470 and printed circuit board 70 in the positions they occupy in FIG. 36**.

Offset Pawls

FIG. 38 is a top plan view of another embodiment of the latch/delatch mechanism, with pawls 480*a* and 480*b* in a somewhat different position than pawls 462*a* and 462*b* occupy in the embodiment of FIGS. 29–37.

In this embodiment, pawls 480*a* and 480*b* located on opposite sides of the space that is occupied by the printed circuit board when it is inserted on the connector, are offset slightly laterally so that when they assume the closed conditions to which they are normally biased (as in FIG. 39), the retention of printed circuit board 70 within the connector body is somewhat more secure.

In this embodiment, elongated slot 486 is wider, to accommodate the offset pawls. This, in turn, requires post 484 to be wider than in the embodiment previously described, which makes slot 486 wider as well.

The above detailed description has been given for ease of understanding only. No unnecessary limitations should be understood therefrom, as modifications will be obvious to those skilled in the art.

I claim:

1. A board-operated connector for connecting a pair of spaced printed terminals located on a printed circuit board with a pair of corresponding output leads carried by said connector in order to connect the terminals with other parts of the electrical system with which the printed circuit board is used, said pair of printed terminals being arranged in a column oriented transverse to a first edge of said circuit board, the first of said terminals lying farther than the second terminal from said board edge with its boundary that is nearest said edge located at a first predetermined distance from the edge, with its geometric center lying a second predetermined distance from said board edge, and with its boundary that is most remote from said edge lying a third predetermined distance from the edge, the geometric centers of said printed terminals being spaced from each other by a fourth predetermined distance, said second printed terminal lying with its boundary that is most remote from said edge at a fifth predetermined distance from the board edge, which connector comprises:

(a) a pair of output leads;

(b) first and second contacts, each of said contacts having:

(i) a free end associated with a predetermined one of said printed terminals and electrically connected with a predetermined one of said output leads, (ii) an open position, and (iii) a closed position for contact with its said associated printed terminal;

(c) a narrow hollow body formed of rigid, insulative material for housing said contacts and for carrying said output leads fixedly attached to said connector body and extending outward therefrom, said body having a median plane and two main walls parallel to said plane which are connected by two narrow walls, said walls together defining the interior of said connector body and defining an opening for receiving said printed circuit board, said circuit board when inserted by the user of the container in said board-receiving opening being guided through a predetermined path into a operative position within the interior of said body in which position said board is disposed generally parallel to said main walls, said first edge of the circuit board moving past said first and second contacts as the board moves through its said predetermined path, said two contacts being arranged in a column transverse to said board-receiving opening with said first contact positioned nearer to said opening, the geometric centers of said two contacts being spaced from each other by a distance substantially equal to the aforesaid fourth predetermined distance;

(d) resiliently deformable, elongated support means for each of said first and second contacts, each of said support means:

(i) normally supporting its respective contact in the contact's open position, and (ii) being insulated, together with its associated contact, from the other of said two contacts and the latter's associated support means;

(e) actuator means for each of said resiliently deformable support means, each of said actuator means being positioned to deform the support means with which it is associated to urge its respective contact, in a direction generally normal to said median plane, into its said closed position; and (f) means for operating both said actuator means in automatic response to the insertion of the printed circuit board in said board-receiving opening and movement of the board along said predetermined path, said means for operating said actuator means comprising movable carriage means positioned alongside said pair of elongated support means and supporting at least one of said actuator means, at least one of said actuator means comprising a rigid pin formed of insulative material extending perpendicularly from said carriage means in a direction transverse to its associated elongated support means, said carriage means:

lying entirely outside said predetermined path followed by said printed circuit board, when it is inserted in said connector body and is moved along said path, at least until the board first reaches a safe position, and as the board is moved farther along said predetermined path into its said operative position, being pushed by said board to cause said at least one actuator means supported on said carriage means to press its associated contact toward its fully closed position, said carriage means operating said actuator means only after the printed circuit board has been moved, while said first contact is held by its said support means in its normal open position, to said safe position within the interior of said connector body, in which position said first edge of the circuit board has moved along said predetermined path of the circuit board beyond said first contact a distance greater than the aforesaid fifth predetermined distance, but less than said first predetermined distance, to bring said first contact to a position between said first and second terminals, said carriage means, in automatic response to insertion of said printed circuit board in said board-receiving opening and movement of the board along its said predetermined path to an initial contacting position, in which position said first edge of the circuit board has moved beyond said first contact a distance greater than the aforesaid first predetermined distance, but less than said third predetermined distance, causing said actuator means to move said contacts into contact with their respective printed terminals on the printed circuit board, whereby all contact between said first contact and said second printed terminal is avoided from the time the printed circuit board is inserted within the connector at least until it reaches its said safe position, and whereby said contacts are brought into initial contact with their respective printed terminals on the printed circuit board only after the board has been inserted in said connector body to its said initial contacting position, and into full pressure contact with said printed terminals only after the circuit board has been moved into its fully operative position within the connector body.

2. The connector of claim 1 in which, in automatic response to insertion of said printed circuit board in said board-receiving opening and movement of the board along its said predetermined path to a ready position within the interior of said connector body, in which position said first edge of the circuit board has moved along said predetermined path of the circuit board beyond said first contact a distance greater than the aforesaid first predetermined distance but less than said second predetermined distance, said first and second printed terminals have been brought to positions adjacent said first and second contacts, respectively, to ready said two actuator means to move said contacts into initial contact with their respective printed terminals on the printed circuit board.

3. The connector of claim 1 in which, in automatic response to insertion of said printed circuit board in said board-receiving opening and movement of the board along its said predetermined path to its said operative position, in which position said first edge of the circuit board has moved beyond said first contact a distance approximately equal to the aforesaid second predetermined distance and less than said third predetermined distance, said means for operating said actuator means has caused said actuator means to move said contacts into their fully closed positions in full pressure contact with their respective printed terminals on the printed circuit board.

4. The connector of claim 1 in which said movable carriage means includes:

(a) an arm positioned alongside said pair of elongated support means, with said at least one transversely extending rigid pin mounted thereon; and (b) an abutment extending from said arm into said predetermined path of the printed circuit board at a location lying at a distance from said first contact that is greater than the aforesaid first predetermined distance but less that said second predetermined distance.

5. The connector of claim 4 in which said arm is positioned immediately adjacent said pair of elongated support means.

6. The connector of claim 1 in which said movable carriage means on which said at least one rigid actuator pin is supported is slidably mounted in a groove in the inner surface of at least one of said main walls of said connector body.

7. The connector of claim 1 in which said resiliently deformable support means associated with each of said contacts is an elongated member with the base portion thereof anchored to said connector body and with its other end carrying its associated contact.

8. The connector of claim 7 in which the base portions of said two elongated, resiliently deformable support means are arranged one upon the other in a stack normal to the median plane of said connector body, with said two base portions being separated by electrically insulative material.

9. The connector of claim 7 in which said elongated resiliently deformable support means for each of said contacts is an electrically conductive flat spring member.

10. The connector of claim 7 in which each of said contacts is integrally formed with its respective resiliently deformable support means.

11. The connector of claim 7 in which each free end of said elongated support means associated with said first contact extends closer to said board-receiving opening than does the free end of said elongated support means for said second contact.

12. The connector of claim 1 in which:

(a) said elongated, resiliently deformable support means for each of said contacts is an electrically conductive spring member, (b) a first portion of said spring member for at least one of said contacts slants diagonally with respect to the median plane of said connector body, with the end of said first slanting portion that is nearer to said board-receiving opening opening being closer to said median plane, and (c) said actuator pin associated with said at least one contact, when said carriage means is moved longitudinally of said spring member towards the base portion thereof after said printed circuit board is inserted in said connector body, moves longitudinally along said first slanting portion of said spring member to press the same towards said median plane and bring its associated contact into its said closed position in contact with its associated printed terminal.

13. The connector of claim 12 which includes means for holding said carriage means within said connector body when no printed circuit board is inserted in said body.

14. The connector of claim 13 in which said resiliently deformable support means for at least one of said contacts includes means for holding said support means against said actuator means to restrain movement of said actuator means in the direction opposite the direction in which said printed circuit board moves when it is inserted into said board-receiving connector body, thereby holding said carriage means within said connector body when no printed circuit board is inserted in said body.

15. The connector of claim 14 in which a second portion of at least one of said spring members slants diagonally with respect to the median plane of said connector body, with the end of said second slanting portion that is nearer to said board-receiving opening being farther from said median plane, to hold said actuator means and the carriage means on which it is supported within said connector body when no printed circuit board is inserted within said body.

16. The connector of claim 15 in which said second slanting portion of said at least one spring member is located at the free end of said member.

17. The connector of claim 16 in which said first slanting portion of said at least one spring member is located at the free end of said member.

18. The connector of claim 1 in which said operating means operates said two actuator means directly.

19. The connector of claim 1 in which:

(a) said elongated, resiliently deformable support means for each of said contacts is an electrically conductive spring member, and (b) each of said spring members that supports one of said contacts:

(i) extends from its base portion to a first location nearer to said board-receiving opening than its associated actuator pin, (ii) extends from said first location in a direction towards said median plane to a second location adjacent said median plane, the contact supported by said spring member being positioned approximately at said latter location, and (iii) extends from said second location in a direction away from said board-receiving opening to an associated actuator pin, to which pin the free end of said spring member is secured.

20. The connector of claim 19 in which the free end of each of said spring members is secured to its associated actuator pin with a slip fit.

21. The connector of claim 1 in which said operating means includes:

(a) means for operating a given one of said two acturator means directly; and (b) means for operating the other of said actuator means, in turn, in response to the operation of said given actuator means, by transmitting a mechanical force from said given actuator means through the resiliently deformable support means for the contact that is associated with said given actuator means, and from said support means to the other of said two actuator means, whereby both said contacts are moved into initial contact with their respective printed terminals on the printed circuit board.

22. The connector of claim 21 in which:

(a) said given actuator means is located within the interior of said connector body in a position exposed to the application of translational force by said operating means in automatic response to (i) the insertion of said printed circuit board in said board-receiving opening and (ii) movement of the board to an initial contacting position within the interior of said connector body, in which position said first edge of the circuit board has moved along said predetermined path of the circuit board beyond said first contract a distance greater than the aforesaid said first predetermined distance but less than said third predetermined distance;

(b) said two resiliently deformable support means are disposed and arranged so that movement of the support means associated with said given actuator in a direction normal to said median plane of the connector body causes movement of the other of said support means in a similar direction; and (c) when translationa1 force is applied as aforesaid to said given actuator, said actuator presses against its associated resiliently deformable support means:

(i) to cause said support means to be deformed and move its associated contact in a direction generally normal to said median plane into initial contact with its associated printed terminal on said printed circuit board, and (ii) at the same time, through said movement of the support means for said given contact, to cause said other contact to move in said generally normal direction to bring it also into initial contact with its associated printed terminal on said board.

23. The connector of claim 22 in which:

(a) the contact associated with said given actuator means is said first contact;

(b) said resiliently deformable support means for said first contact is:

(i) spaced farther from said median plane than is the support means for said second contact, and (ii) located in a position adjacent to and overlying said last mentioned support means;

(c) actuator means for said second contact is provided between said two adjacent, resiliently deformable support means, said actuator means being formed of insulative material; and (d) when said actuating force is applied against said resiliently deformable support means for said first contact, said support means:

(i) causes said first contact to move, in a direction generally normal to said median plane, into initial contact with its associated printed terminal on said printed circuit board, and (ii) at the same time, causes said actuator means for said second contact, in turn, to press in said generally normal direction against the resiliently deformable support means associated with said second contact, to bring said second contact also into initial contact with its associated printed terminal.

24. The connector of claim 23 in which:

(a) each of said resiliently deformable support means is elongated in shape; and (b) said actuating force is applied to said resiliently deformable support means for said first contact by a rigid actuating pin formed of insulative material, said pin being supported on movable carriage means and extending perpendicularly therefrom in a direction transverse to its associated elongated support means, said carriage means:

(i) lying entirely outside said predetermined path that is followed by said printed circuit board, when it is inserted in said connector body and is moved along said path, at least until the board first reaches its said safe position, and (ii) as the board is moved farther along said predetermined path into its said ready and initial contacting positions, being pushed by said board to cause said actuator means for said first contact to press its associated resiliently deformable support means in a direction generally normal to said median plane to move its associated contact into its closed position, and at the same time to press, through said last mentioned support means, against said actuator means for said second contact to move its associated resiliently deformable support means and the contact supported thereby in a direction generally noramal to said median plane to bring said second contact into contact with its associated printed terminal, whereby both said contacts are brought into initial contact with their respective printed terminals on the printed circuit board only after the board has been inserted in said connector body to its said initial contacting position, and into full pressure contact with said printed terminals after the circuit board has been moved into its fully operative position within the connector body.

25. The connector of claim 24 in which said movable carriage means includes:

(a) an arm positioned alongside said pair of elongated support means, with said transversely extending rigid pin mounted thereon; and (b) an abutment extending from said arm into said predetermined path of the printed circuit board at a location lying at a distance from said first contact that is greater than the aforesaid first predetermined distance but less than said second predetermined distance.

26. The connector of claim 23 in combination with a printed circuit board in which:

said operating means is comprised of post means mounted on said printed circuit board adjacent said first edge of the board, and said actuator means for said resiliently deformable support means for said first contact is comprised of a hood mounted on said post means with an edge portion of said hood spaced from and overlying said printed terminals, said hood edge portion, when said printed circuit board is inserted in said board-receiving opening and moved along said predetermined path to its said operative position, applying actuating force to said resiliently deformable support means associated with said first contact to press said first and second contacts first into initial contact with the respective printed terminals with which they are associated, and then into their fully closed positions in full pressure contact with their respective printed terminals on the printed circuit board.

27. The connector of claim 1 in which the direction of movement of said printed circuit board through said predetermined path within said connector body is substantially perpendicular to said first edge of the printed circuit board when the circuit board is inserted in said board-receiving opening.

28. The connector of claim 1 in which other pairs of printed terminals similar to said first mentioned pair are disposed adjacent said first edge of the printed circuit board to form a multiplicity of pairs of terminals, each of the terminals in said other pairs of printed terminals:

(a) being arranged in a column oriented transverse to said first edge in a manner similar to the arrangement of the terminals in said first pair or printed terminals; and (b) having associated with it in said connector an output lead, a contact, resiliently deformable support means, actuator means and operating means as hereinbefore recited for each terminal in said first pair of printed terminals.

29. The connector of claim 28 in which:

(a) at least one row of additional similar printed terminals is disposed parallel to and immediately adjacent said first board edge between said edge and said multiplicity of pairs of terminals, and (b) each of said additional printed terminals has associated with it in said connector an output lead, a contact, resiliently deformable support means, actuator means and operating means as hereinbefore recited for each terminal in said first pair of printed terminals.

30. The connector of claim 1 in which:

(a) said pair of printed terminals is disposed adjacent and along a second edge of said printed circuit board that is perpendicular to said first edge;

(b) at least one additional similar printed terminal is disposed in a column with said first and second printed terminals along said second board edge;

(c) said at least one additional printed terminal is located immediately adjacent said first board edge between said edge and said second terminal; and (d) each of said additional printed terminals has associated with it in said connector an output lead, a contact, resiliently deformable support means, actuator means and operating means as hereinbefore recited for each terminal in said first pair of printed terminals.

31. The connector of claim 1 in which withdrawal of said printed circuit board from its said operative position in said connector body past its initial contacting position breaks the contact between each of said contacts and its associated printed terminal.

32. The connector of claim 31 which includes means to hold said printed circuit board in its said operative position within the connector body after it has been placed in said position by the user of the connector, said holding means being selectively releasable by the user of the connector.

33. The connector of claim 32 in which said holding means comprises a latch/delatch mechanism that includes:

(a) means defining an elongated slot in said printed circuit board;

(b) elongated, resiliently deformable pawl means secured at its base portion to said connector body and carrying a hook portion at its free end that is normally biased to a position within said slot to retain said printed circuit board in its said operative position after it has been inserted in said connector body, the outer end of said hook portion comprising an inclined surface adjacent the printed circuit board; and (c) a plug member slidably confined in said elongated slot in said printed circuit board, said plug member having an outer face remote from said board, said board being movable by the user of the connector farther within said connector body beyond its aforesaid operative position to press said slidable plug against the inclined surface of the outer end of said hook portion to bend said pawl outward away from the printed circuit board and slide said hook up on said outer face of the plug, where the friction between the hook and plug keeps said latter two members engaged while said printed circuit board is being withdrawn from said connector body, said plug sliding in a lost-motion movement within said elongated slot in the board to prevent said hook portion from reinserting itself within said slot.

34. The connector of claim 33 in which two of said elongated, resiliently deformable pawl means are secured to said connector body, one of said pawl means being located with its said hook portion biased as aforesaid from one side of said circuit board and the other being located with its said hook portion biased as aforesaid from the opposite side of said board, the free ends of said elongated, resiliently deformable pawl means of the latch/delatch mechanism being offset laterally to cause their respective hook portions at said free ends to be biased within said slot in the printed circuit board without abutting each other.

* * * * *